US008302803B1

(12) United States Patent
Greenberg et al.

(10) Patent No.: US 8,302,803 B1
(45) Date of Patent: Nov. 6, 2012

(54) CONTAINER WITH LIQUID FOR ATTACHMENT TO AND MIXING WITH POURED LIQUID OF CONVENTIONAL CAN

(75) Inventors: Russell Jon Greenberg, New York City, NY (US); Christopher Eden Marchant Beardsley, New York City, NY (US)

(73) Assignee: WIX Industries LLC, New York City, NY (US)

( * ) Notice: Subject to any disclaimer, the term of this patent is extended or adjusted under 35 U.S.C. 154(b) by 27 days.

(21) Appl. No.: 12/884,002

(22) Filed: Sep. 16, 2010

Related U.S. Application Data

(63) Continuation-in-part of application No. 12/070,461, filed on Feb. 19, 2008.

(60) Provisional application No. 61/276,719, filed on Sep. 16, 2009.

(51) Int. Cl.

| | |
|---|---|
| ***B65D 23/12*** | (2006.01) |
| ***B65D 83/00*** | (2006.01) |
| ***B65D 1/04*** | (2006.01) |
| ***B65D 1/24*** | (2006.01) |
| ***B65D 1/36*** | (2006.01) |
| ***B65D 25/04*** | (2006.01) |
| ***B65D 57/00*** | (2006.01) |
| ***B65D 85/00*** | (2006.01) |
| ***B65D 25/08*** | (2006.01) |
| ***B65D 81/32*** | (2006.01) |
| ***A47G 19/22*** | (2006.01) |
| ***B67D 7/74*** | (2010.01) |
| ***B67D 7/78*** | (2010.01) |
| ***B67D 3/00*** | (2006.01) |

(52) U.S. Cl. ..... 220/703; 220/715; 220/506; 215/386; 215/287; 215/6; 206/219; 222/129; 222/145.1; 222/478; 426/120

(58) Field of Classification Search ..... 215/387, 215/DIG. 8, 6, 386; 220/506, 703, 715, 501, 220/503, 711, 713; 222/145.1, 145.5, 129, 222/478, 481; 426/120

See application file for complete search history.

(56) References Cited

U.S. PATENT DOCUMENTS

| | | | | |
|---|---|---|---|---|
| 2,075,721 | A * | 3/1937 | Hommel | 220/717 |
| 2,631,521 | A | 3/1953 | Atkins, Jr. | |
| 3,413,128 | A * | 11/1968 | Steinbarth et al. | 426/115 |
| 4,054,205 | A * | 10/1977 | Blow et al. | 206/217 |
| 5,170,888 | A | 12/1992 | Goncalves | |
| 5,255,812 | A | 10/1993 | Hsu | |
| 5,318,787 | A * | 6/1994 | Brauner et al. | 426/120 |
| 6,786,330 | B2 | 9/2004 | Mollstam et al. | |

* cited by examiner

*Primary Examiner* — Anthony Stashick
*Assistant Examiner* — Andrew T Kirsch
(74) *Attorney, Agent, or Firm* — Andrew S. Langsam; Pryor Cashman LLP

(57) ABSTRACT

A device for selective attachment to a conventional aluminum beverage can with internal liquid-holding pouch. A flavoring, alcohol based, energy drink, a medication, etc. can be contained in the device and mixed with the liquid contained in beverage cans. With the device atop a can and the device and can opened, tilting and pouring the liquid of the can causes liquid within the device to be dispensed and entrained into the stream of the liquid exiting the beverage can. A mixed drink can be provided comprised of the first liquid of the device and the second liquid provided by the can. Substantially uniform concentration of the two liquids is maintained from start to finish. Mixing occurs on an incremental basis and there is no substantial mixing of liquid from the device within the chamber of the can or from the liquid of the can within the cavity/pouch of the device.

33 Claims, 15 Drawing Sheets

CONTAINER WITH LIQUID FOR ATTACHMENT TO AND MIXING WITH POURED LIQUID OF CONVENTIONAL CAN

RELATED APPLICATIONS

The present application claims priority on U.S. Provisional Patent Application Ser. No. 61/276,719 filed Sep. 16, 2009 and upon U.S. non-provisional patent application Ser. No. 12/070,461 filed Feb. 19, 2008. The specifications and teachings of those references are specifically incorporated herein.

BACKGROUND OF THE INVENTION

The present invention relates to a preferably disposable after use, liquid-containing device which is adapted in its preferred embodiment for attachment to an ordinary i.e., commercially sold, standard aluminum soda or beer can so that the liquid of the device will be poured with the liquid of the soda or beer can for substantially uniform mixing and consumption. For ease of reading and understanding, the inventive liquid-holding device may be referred to as "the device" or "the first liquid-holding device" and the container to which the device is to be attached is often referred to as "the can" or the "second liquid holding can" (it being understood that the device can also be used with other liquid holding containers or cans, e.g., a drinking cup; a mug; a pitcher; a paper, Styrofoam, or other coffee-type cup; etc., —indeed, any vessel with an upper lip for holding the device and a liquid pouring mechanism (like a spout) for dispensing liquid from the can).

In the preferred embodiment, the device is hollow, basically doughnut-shaped (from the top view), yet, with a side, downwardly extending first liquid holding chamber or pouch. The device initially holds the first liquid which will be poured along with the pouring of the second liquid from the can. The device is initially provided to the consumer prefilled with the first liquid. In its preferred embodiment, the device will hold an added-in first liquid of about 50 ml which, in the standard use, will be admixed as dispensed to the 355 ml of the second liquid of the can. The device is provided with an aperture for pouring the liquid out, as desired. In its preferred embodiment and construction the device is intended for easy, attachable use to a standard soda or beer can of the type sold to consumers for individual use. These cans can be of the 4 ounce, 8 ounce, 8.3 ounce, 12 ounce (355 ml.), and even 16 ounce capacities. Larger and smaller sizes can be accommodated, too. A desired goal of the present invention is the basically consistent and substantially uniform mix or concentration of a measured dosage of the liquid of the device with the fluid or liquid being poured by the can, on a per sip basis. Incremental mixing on a per sip basis is highly desired for consistent flavor, consistency of concentration, etc. Unlike other mixing technologies that substantially all at one time combine the entire contents of a first added liquid with the liquid of another vessel, i.e., all at once into a cohesive mixture (i.e., the mixing occurs within one, both or another separate vessel) the present invention delivers substantially uniform and consistent doses of the liquid of the device, the first liquid, into and along with dispensing poured doses of the second liquid of the can, on a per-sip or per unit pouring basis so that the two fluids or first and second liquids mix right before entering a user's mouth. The present invention prevents the liquids of the can and the device from prematurely mixing and allows them to mix at the moment of intended consumption.

Accordingly, the present invention is intended to provide a first liquid contained within the device for mixing with the poured second liquid of the standard beer or soda can so as to alter the taste, color, flavor, and/or characteristic of the second liquid originally within the can so that, upon pouring of the same, the two liquids merge, entrain, and a mixed drink results for the consumer. The device is (before liquid is provided) basically hollow so as to carry within it a volume of the first liquid to be combined with the liquid of the can for a mixed drink, when the device and can are simultaneously tilted and poured.

Alternatively, the construction of the device or present invention can be modified to be secured to the top, generally circular lip of any liquid-holding and beverage drinking/dispensing device, e.g. a paper or Styrofoam coffee cup; a plastic beverage cup, a cocktail glass; a pitcher, mug, stein, i.e., any glass-, ceramic-, paper- or plastic-, etc., holding/drinking vessel which is used for pouring consumable liquid. Hereinafter for ease of reading and understanding, all such vessels, whether glass, plastic, aluminum, cardboard, etc., disposable or reusable after use, are collectively referred to as "cans" and the present invention will generally be described for use with conventional and readily available standard aluminum cans as that is the preferred environment for use of the device, although, clearly, the invention can be modified for use with other drinking and liquid-holding vessels and containers.

In its preferred embodiment, the device is intended to be pre-filled by the manufacturer with a specific, first liquid or fluid. When prefilled with its own liquid, for example, cherry flavoring, vodka or rum, an energy supplement, a pharmaceutical liquid, etc. and secured (by secure or snap-on placement on the top lip or around the top flange of the soda or beer can) and the two items (first liquid-holding device, i.e., the present invention and the can) "opened" (by unblocking the aperture of the device and popping the "pop top" of the can) and the two (device and can) tilted over for drinking or pouring, the poured liquid of the device of the present invention becomes thoroughly entrained into the exiting liquid of the conventional aluminum can or drinking vessel to provide a mixed drink of the two liquids. The consumer will drink from the opening of the can and the fluid of the device mixes with the fluid of the can, so that the two liquids basically become a mixed drink within the confines of the user's mouth. The lower lip of the user is placed onto the upper rim of the device, near its opening in much the same way that a user conventionally drinks from a can. The device, when snapped onto the top and the flange of the can provides a substantially fluid tight seal with the top of the can so that tilting and pouring of the can and the device causes the two liquids to be poured into the mouth of the user.

As the consumer tilts and drinks from the can, the liquid of the device is mixed with the fluid of the can to provide the desired and metered concentration of a mixed drink. The device, with its first contained liquid, is intended to be attachable (yet, after consumption, detachable for disposal and/or recycling separation) to the top rim or flange of a can, the latter containing a specific, second fluid of a different flavor or consistency. The two will be poured together to provide a mixed drink, different than the pure liquid of the device and the initial liquid of the can, if they were poured separately. So, for example only, the can may contain cola and the device may contain alcoholic rum, so that the mixed drink is a "rum and cola" concoction. Other end resulting or mixed drinks could be, for example, cherry flavoring from the device and cola from the can for a cherry-flavored soda; or vanilla flavoring from the device and cola from the can for a vanilla-tinged soda drink; or orange juice from the can and vodka from the device to result in a mixed drink known as a "screwdriver;" or beer from the can and an energy-providing or caffeine stimulant, etc. from the device of the present invention. The present invention can also be useful for delivery of a liquid pharmaceutical to children by "masking" the same with a cola, orange juice, apple juice, etc., the latter contained within a standard aluminum can and the cherry-flavored cough syrup provided from the device. If the two were mixed before pouring or drinking, the mingling of one fluid or liquid with another could have deleterious effects on the other (probiotic supplements might be rendered ineffective if they were added to a cola and left to mix for even a few minutes). The present invention prevents the liquids or fluids of the device and the can from interacting until the moment of consumption.

The available and consumable liquids in cans are widely varied and many consumers may want to drink them as purchased and, yet, the present invention provides some significant ability to alter the taste or characteristic of the liquid of the can thus providing versatility to the consumer who purchases one or more standard cans in that the consumer can make a desired mixed drink from the conventionally available can by simply selecting the desired added-in liquid, provided by the device of the present invention.

Once the device is secured to the top of the can, the apertures of each opened, and the can and device simultaneously tilted (until the level of the fluids are above the apertures of the device and can) the two fluids will simultaneously pour out of the can and device resulting in the entrainment of the liquid of the device with the liquid stream of the can or, if entrainment does not occur do to mis-alignment of the two apertures, the mixing of the two liquids within the user's mouth, upon drinking. This can be for direct pouring and drinking into the throat of the user or for pouring into another holding, pouring and drinking vessel, if desired. Preferably, the present inventive device is pre-filled by a manufacturer (a rum maker, for example; a brand manufacturer of vodka; an energy boosting liquid supplier; a liquid pharmaceutical manufacturer, etc.) with its own liquid and then sealed. Two or more of the devices, in the preferred construction, can be nested together to minimize horizontal shelf space. The consumer will then purchase the device(s) and open and use the same, when and if desired, i.e., when consumption of the liquid of the can as modified by the liquid of the device is desired. It is also within the contemplation of the inventors for the device to be fillable and/or refillable by the consumer at his/her home or at work (or at the beach, a parking lot with a tailgate party, etc.) with any suitable liquid and then used or sealed for later consumption and use. It is contemplated that the device can be for a single use and then disposed or it can be refillable.

The device basically comprises two, thin-walled, preferably plastic and inexpensive pieces, in the preferred embodiment, a top piece comprising a first chamber-covering or sealing piece with a smooth upper-directed lip wall for engagement with the bottom lip of the consumer, upon drinking, and a bottom, a second, lower piece, extending along the side of a portion of the can and defined by an initially empty chamber or pouch which is then filled with the first liquid. The two pieces are sealed together along their outside rims and along the internal edges defining their central apertures. The second piece is provided, at its upper section, with an inverted U-shaped channel for snapping around or onto the upwardly extending rim or circular flange of the can. Both the top or sealing piece and the bottom or principal chamber-holding piece are provided with centrally located and aligned openings which overlay the top of the can to which the device is secured, in use. This allows the user access to the pop top tab and to the adhesive tab covering up the aperture of the device.

When the device is installed and snap fit to the flange of the can, the device provides a somewhat liquid proof seal between the top surface of the can and the outside cylindrical wall of the can so that liquids flowing out of the can and the device (during tilting) are directed over the upwardly extending lip of the device and into the user's mouth and not down the sidewall of the can.

When desirably used, the device is placed and snap-fit onto the top of the can (either by resilient snapping of the inverted U-shaped channel over the inside and outside edges of the flange of the can or by more simply having the device snap around the outside of the flange of the can. Preferably, the device is formed such that the bottom piece (substantially comprising the pouch of the device) is provided with a bottom-located, inverted U-shaped channel which snaps onto the upwardly extending and encircling top lip, flange or rim of the can. Then, with the device so located, the aperture of the device can be opened. That can be done either before attachment to the can or after. Subsequently the can is opened by removal or typical opening of the conventional pop top tab. The order of opening the device and the can may be reversed, of course.

The annular lip of the first or top piece of the device extends upwardly and is thin in profile and smooth-walled to allow the user's mouth to easily and comfortably fit over it without injury nor discomfort. The device is like a "second skin" conforming to and fitting over the flange or rim of the can with the annular lip of the top piece being vertically offset above the top of the can but substantially replacing it in "feel" for the user so that placement of the user's lower lip around the rim of the device, with the user's mouth over the device is instinctive and quite conventional. The inside diameter of the lip and annular opening of the top piece and the aperture of the bottom piece of the device are large enough to allow for enough room for the user's fingers to gain access to the pop top or pull tab of the can and to the separate mechanism for opening the device, whether it has its own pop top tab-like device or a simple removable tab, etc. The lip of the device is of a very small thickness to allow the lower lip of the user/drinker to engage the outside of the lip of the device and the top lip of the user to extend above the fluid opening of the device so that the first liquid of the device will easily flow into the user's mouth, at the same time as the second liquid flows and entrains into the can's out-flowing liquid. In effect, the user's mouth is a mixing chamber for the first liquid of the device and the second liquid of the can.

Characteristic of the present invention is the shape and profile of the bottom edge of the second or bottom section and the shape, outward extension, profile and parameters of the pouch or liquid-holding chamber. As mentioned, the liquid-holding pouch of the second or bottom piece of the device preferably extends along the curvature of the exterior side wall of the can. This serves multiple purposes. By holding the first liquid near the can, as the can is emptied of liquid, the liquid of the device will still be located near the can's outside circumferential wall so that the probability of the can and device tipping over and spilling is reduced. Also, the lower edge of the pouch is contoured and extends lowermost opposite to the fluid, pour opening or exit aperture of the device. This, in combination with the first or top section of the device tends to ensure that some level of liquid is substantially always maintained above the aperture of the device (when tilted for pouring/drinking) so that when the device is tilted along with the can, the first liquid of the device will be poured and admixed with the second liquid of the can so that a basically uniform concentration of first and second liquid is substantially provided to the drinker/user. The bottom edge of the second or bottom section, defining the pouch or first liquid, primary holding chamber of the device, is sloped away from the opening of the device and then extends across the back of the device, opposite to the opening. The angle and shape of the bottom profile (sine wave like in side view) of the pouch of the second section or bottom piece achieves the following:

When the can and device atop it are standing upright on a table top, all of the first liquid (of the device) and second liquid (of the can) are below their respective liquid exit apertures (called a pour opening for the device and the aperture of the can) ensuring that there will be no spillage and that no additional amount of first liquid will flow out of the device and into the can or vice versa;

Since the bottom edge of the chamber-pouch is angled causing the distribution of the first liquid to be greater opposite from the drinking opening, when a user tilts the can to drink from it, there is generally some amount of first liquid above the device's exit aperture (called pour opening) and thus first liquid is available for mixing. The angle of tilt changes, of course, as the user continues to drink from the can as there becomes less liquid in the can as second liquid is removed. Yet, the configuration of the device, the profile of the bottom wall of the chamber/pouch and the construction of the fluid holding chamber comprised of chamber portions in the top and the bottom piece is such that the device provides a somewhat consistent flow of first liquid as the can is tilted such that the mixed drink flowing from can and device is substantially uniform on a per sip basis.

The angled bottom wall of the pouch also provides that the last drops of first liquid are able to flow through the opening and are available to be mixed before the contents of the can with its liquid emptied during the course of "normal sipping" i.e., as opposed to a complete chugging of the contents all at once.

According to another aspect of the invention, the side wall of the device, at or adjacent to the pouch or chamber, is somewhat compressible and resilient by finger pressure of the user. In this manner, during tipping/tilting of can and device atop it for drinking, the user can press on the outside wall of the device and thus the slight finger pressure causes pressure within the liquid holding chamber to increase and thus an additional amount of first liquid will be dispensed (beyond that provided based solely on geometry and gravity). This can be important for taste and if the user, for example, doesn't want to consume the entire contents of the can but, rather, wants more of the liquid of the device than the normal concentration provided when the entire contents of the can are consumed.

During initial sipping, some volume of the first liquid of the device will lie above the exit aperture of the device and, yet, during additional tilting and sipping, the volume ideally remains somewhat constant above the aperture so that as the user tilts the can (and its attached device) more and more with progressive sipping, the user is provided with a substantially constant amount of first liquid for each unit quantity of second liquid flowing from the can. When the can is only tilted slightly, for a first or initial set of sipping/drinking of mixed liquids, there may be a small amount, possibly, for example, only about 10 ml of first liquid above the exit aperture, the rest remaining below the level of the exit aperture. Then, after more liquids have been drained from the device and the can, later sipping/drinking by the user can be accomplished when the can and device are more severely tilted and, yet, there is still roughly, some, for example, another 10 ml or at least a small reservoir of first liquid above the level of the exit opening or aperture of the device and able to mix. This in conjunction with the size and configuration of the opening, and the velocity of the first liquid produced during normal sipping motion, which serves to forcibly eject liquid through the opening even in the absence of a vent hole or pressure applied to the outside wall of the device, promotes a substantially steady rate of first liquid flow per unit of second liquid flow. If the rate of flow of the first liquid on the early sipping was much greater than on later sipping, the user would not experience a consistent mixing/concentration of first liquid provided by the device to the second liquid provided by the can. The present invention provides for a basic consistent flow rate of first liquid per unit or sip of second liquid from the can. This is highly desired.

The device can be one-time usable and then disposable or it can be refillable and reusable. In any event, the present invention, a liquid-containing device with a first liquid can be attached to a can with a different or second liquid and when the can is tipped or tilted by hand for drinking, the device is tipped with it and the first liquid of the device flows out of it and into the stream (or directly into the mouth of the user) along with the second liquid flowing out of the can. Mixing occurs at the exit stream of the device and the can or in the user's mouth. According to the preferred embodiment of the invention, the two liquids become a single combined and mixed liquid, i.e., the first liquid becomes entrained into the stream of flow of the second liquid (usually the can's stream of outflow is greater in volume than that of the device) and a mixed liquid is thus capable of consumption by the consumer. The exit flow rate of the liquid of the device can be adjusted by the manufacturer by the size, shape, location, etc. of its holding chamber and/or the size and shape, number of holes or perforations of the aperture or it may be adjusted by the consumer by an incremental opening and closing (by a mechanism) of the aperture of the device. The volume of contained fluid within the device; the size and shape of the liquid holding chamber/pouch; the location, shape and size of the device's outflow aperture or orifice, etc. determine the timing, character and nature of the stream of the first liquid of the device and the manner with which it becomes mixed with the liquid pouring out of the can. Preferably, the size, shape of the pouch, volume, its aperture, etc. are coordinated and sized so that a predetermined mixed concentration of first liquid to second liquid is substantially maintained until both the device and the can are substantially simultaneously consumed and emptied.

The present invention thus contemplates providing an originally hollow but then liquid-filled device for securing to a can which can selectively mix its liquid with that of the can for providing a mixed drink to the consumer. This is expected to be highly desirous by those wishing to mix, for example, the fluids of commercially available cans with selected flavoring liquids, on an individual basis. For example, it is envisioned by the inventors that the primary can may contain Coca-Cola; Pepsi, 7 Up, or another cola drink (collectively referred to as "the second liquid") and the device may contain a brand of rum-based alcohol; or the primary can may contain orange juice and the device mix into the stream of the can a first amount of liquid vodka to produce a screwdriver mixed drink. Other possible combinations exist as, for example, coffee or caffeine-flavored water (first liquid of the device) with beer (second liquid of a can); energy boosting drink (e.g., Red Bull® energy drink as the first liquid in the device) and cola as the second liquid in the can. Other combinations are clearly available and can be as varied as the commercially available liquids and flavorings and add-ins for liquid, all to the extent suitable for human consumption.

The present invention, a liquid-holding container for selective use with a can is expected to allow a single six-pack of cola, for example, to be divided up among family (adults and children) or friends and each person can then individualize or have provided to them an appropriate and desired drink by adding a flavoring, supplied by an individual device, one per can, as appropriate. Thus, one child could drink the cola from a first can without modification; another child may decide (and have the parent agree) to flavor his cola can by adding a cherry flavoring (cherry syrup being provided by the device of the present invention); an adult may decide to add rum to the standard cola can with the rum obtained from and provided by the device to the same conventionally available cola can; a teen-ager in the family may add an energy boost provided by the device to yet another standard cola can, and the final adult may add vanilla extract flavoring from the device to the standard can of cola (and one can is left over for whoever wants another drink later). Thus, a single six pack of identical cola cans can produce, with the present devices suitably filled with a variety of predetermined first or primary liquids of flavors, alcoholic add-ins, energy-boosters, etc., a wide variety of drinks. The devices of the present invention are small, relatively light weight and can be shaped to be nested in pairs (one such device nests into the inverted and rotated by 180 degrees second of such device) for efficiency of packaging and to conserve shelf space. The devices are preferably removable from the cans and recycled/disposable when emptied (although in an alternate embodiment they can be refillable, if desired). Access to and use of the devices can provide tremendous versatility to the users. A six pack of the devices can also be sold (e.g., all being rum-contained; all containing cherry-flavoring syrup, all energy boosting or vitamin providing, or pharmaceutical containing, etc.) or a six pack of the devices can be formed and sold as an assortment of add-in first liquids. Where alcohol is a component of the first liquid within the device, of course, it must only be purchasable by adults through the proper alcohol-control mechanisms and authorities.

The device is also engineered to be simple to use by consumers and comfortable, too.

The device does not significantly increase the diameter of the can (since the pouch is only slightly greater in outside diameter than the outside diameter of a can) and it extends down the side of the can's height) so that it can still be easily gripped by a consumer with one hand. The configuration and geometry of the chamber of the device exposes a significant portion of the can so that even a smaller hand gripping the can may reach around and grip the can with the thumb of the can only being restable on the outside of the pouch of the device. The slim profile spreads the weight of the first liquid out and around the can, maintaining the liquid close to the center of gravity of the can so that the two, when coupled, do not accidentally tip over and spill liquid.

In an alternate embodiment, a simple friction fit or screw on lid/cover can be provided to the outside of the top lip of the device and/or at or within the center opening of the device so that a can may be partially consumed, then covered for later consumption, and then opened for finishing. A plug may be friction fit into the aperture of the device to prevent its contents from accidental spillage in-between usages.

DESCRIPTION OF THE PRIOR ART

Of course one can add a liquid (like a cough syrup, a flavoring, an ounce of alcohol, etc.) to a drink and consume the mixed drink. This has been done in a variety of ways in the past. An amount taken from a large container or a premeasured packet of the added-in first liquid can be poured into a can or glass of a second liquid for making a mixed drink. A jigger-full of alcohol can be added to a primary liquid first poured into a glass, mug, etc. In addition, mixed drinks have been made by first simply pouring a small amount of the added-in liquid into a separate and large container of second liquid or by pouring a small amount first out of a large container of second liquid and then adding the first liquid, a flavor or characteristic-providing liquid thereto. These are somewhat potentially messy and do not provide for uniform concentration of first liquid to second liquid. Also, it may be the case that premixing before drinking is undesired as it may affect the quality of the mixed drink. Also, on occasion, it has been known for consumers to first imbibe or pour out a small amount of the second liquid from a can so as to allow for air volume in the can. Then, the additive liquid can be poured into the can and the can becomes the mixing chamber. That requires a steady hand lest the first liquid not entirely make its way into the can. Quantities of each and thus concentration of the mixed drink is hard to precisely control All of these methods of providing a mixed drink suffer from one or more disadvantages.

The present invention contemplates the use of a simple to use, lightweight, self-contained, pre-measured, and convenient device which is fillable with a flavor or characteristic changing liquid for mixing with the liquid of a can. The device is easily attachable to the top of the drinking vessel, preferably a soda or beer can, with its aperture (when unblocked) near or directed at the opening of the can. The device can then be selectively opened along with the can and when the two simultaneously tilted for pouring, the liquid of the device is poured out of it and entrains in a measured concentration, with the liquid of the can. Or the mouth of the drinker/user serves as the mixing chamber for the liquids, one from the device and the other from the can. This per-sip mixing and somewhat controlled concentration of first liquid to second liquid while pouring and drinking is an important and distinct aspect of the present invention.

The prior art does not seemingly teach nor suggest this per-sip concentration and mixing mechanism. In addition, the prior art does not teach allowing the liquids of a self-contained device and a can to remain isolated from one another and then, as desired, mix together into a single mixed drink only upon tilting and pouring of the device and can together.

Providing a prefilled device which cooperates with conventional cans is highly desired. Mixing liquids in various environments, e.g., at the beach, in a car, at a stadium, in a backyard, etc. can be difficult where the liquids can easily spill, precise ratios of quantities of the liquids and thus concentrations are not maintained as uniform, etc.

The device also allows for the user to more easily keep track of the portion control of the liquid that they are mixing. For example, if a user pours an amount of alcoholic beverage along with soda into a glass to make a mixed drink, they must either use a measuring device such as a jigger or estimate the amount of alcohol they have poured. Inevitably, in certain social situations the use of a measuring device is too inconvenient and users pour estimated servings of alcohol. This can result in people unintentionally drinking more alcohol than they believe or at least in inconsistent mixed drinks and taste. This device allows users to effectively "count" how many servings of alcohol, calories, mg of caffeine, etc. they have consumed.

Several previous attempts to solve the above and other problems in this field seem to have fallen short. For example, U.S. Pat. No. 2,631,521 to Atkins describes a beverage mixing container attachable to an initially sealed glass container or bottle. The attachment may be affixed to either a bottle on which the cap has been removed or may be affixed to a bottle with the cap still disposed on and over the mouth of the bottle. The Atkins device would fail to work with modern beverage containers such as aluminum cans. Additionally, in order to access (drink) the newly mixed combined beverage, one must first remove the Atkins device from the bottle to gain access to the mouth or opening of the bottle. However, since the bottle is now filled with both its original contents and the liquid contents of the attachment, removal of the attachment may cause spilling and concomitant mess. In any event, the removal of the device containing the first liquid from the top of the can or container with the second liquid to allow for drinking of the combined or mixed liquid is an extra mechanical step, something desirably avoided. This looks fraught with messiness, too.

The present invention also provides a prominent "billboard" i.e., the outside wall of the device for displaying the name, trademark, etc., of the manufacturer supplying the liquid within the device. Thus, the user and others near the user can easily see the advertising prominently provided on a nice and large, continuous surface of the device.

U.S. Pat. No. 5,255,812 to Hsu describes a self-heating food container, such as a tin can, having a food chamber, a first chemical-holding chamber, and a second, separate chemical-holding chamber. The first chemical holding chamber is in thermal communication with the food chamber. The second chemical holding chamber includes a chemical which, when mixed with the chemical in the first chemical holding chamber, causes an exothermic reaction which by conduction and convection heats the food contents of the food chamber. This device is not attachable to a conventional beverage container, nor does it physically mix its heat-generating contents with the food or beverage contained in the food chamber. It is not intended for use with mixing drinkable/consumable liquids. There seems to be no mechanism for metering the quantity of mix of the first chemical with the second chemical as liquids are consumed.

U.S. Pat. No. 6,786,330 relates to mixing liquid technology that combines the entire contents of both vessels all at once into a cohesive mixture (i.e., the mixing occurs within one or both vessels). The present invention, in contrast delivers doses of first liquid into and to mix with doses of second liquid on a per-sip or per pour basis so that the two fluids mix right before and as liquids are entering a user's mouth. One could "say" that the user's mouth actually is the mixing chamber for the first and second liquids. Simply tipping the can and the attached device activates the mixing process in a controlled and substantially even concentration, from initial sip through to emptying the contents of the device and the can.

Other devices, such as that described in U.S. Pat. No. 5,170,888 to Goncalves are also not attachable to conventional modern beverage containers and are complicated and difficult to manufacture.

The present invention is believed to differ from the prior art, either when that art is individually considered or even if combined together, in that the present invention provides a secondary container holding a substance, preferably a first liquid, which mechanically and sealingly attaches to the top of a preferable conventional soda or beer can with pull top tab, which allows for the continuous mixing of the liquids upon tilting the two articles and thus pouring of the same. The desired consumption of a mixed drink through the top of a can, without the need to first remove the device, while maintaining consistent concentration of the liquids, is highly desired. The flow of the first liquid (from the device, i.e., the added-in liquid) can take place through a simple removable, adhesively secured covering tab over an aperture of the first liquid-holding device. The present invention contemplates, unlike the prior art, the consistent mixing of the first liquid of the device with the second liquid of the can to provide a substantially constant concentration of mixed liquid, as the can and device are tipped and tilted. These and other aspects of the present invention, more fully described hereinafter, serve to distinguish the present invention from the prior art teachings.

The present invention, in the preferred embodiment, contemplates that the device be attached to the top of the beer can or soda container, preferably a conventional soda or beer can with a pop top tab. Here, the liquids of the two containers, after removing the seal of the device and the pop top tab of the beer or soda can (irrespective of the order of those steps) will form, in effect, a single mixing as the liquids flow freely into one another during tilting and pouring. The free flow and mixture of the respective liquids at a substantially uniform rate is a desired goal of the present invention.

SUMMARY OF THE INVENTION

As mentioned, the present invention is a device for holding a liquid (like rum, for example, or an energy supplement, a flavoring, vitamin supplement, a liquid pharmaceutical, etc.) which is intended to be snap attached, when desired to be consumed, to the top of a standard aluminum drinking can holding a second liquid (like cola, beer, water, juice, etc.). When used in its preferred embodiment with a conventional aluminum beverage can, the first liquid contained within the device will mix and entrain within the poured (second) liquid or stream of the can into a cup or directly into the user's mouth. This provides a mixed drink comprised of primary (in terms of anticipated volume but denominated second) liquid of the can and the smaller (but called first liquid) of the device.

Thus, clearly, the dimensions and some mechanical features of the present invention i.e., the device, in its preferred embodiment, relate to the dimensions and features of a conventional or standard aluminum beverage can containing a second liquid. The device is intended to be mechanically secured to, preferably atop, the can. By "conventional or standard aluminum beverage can" the inventors refer to the hundreds of millions of aluminum-based cans of soda, beer, and other beverages which are made and sold under trademarks like Coca-Cola; 7Up; Budweiser; Miller; Pepsi; Dr. Brown's; etc., and sold through convenience stores, supermarkets, at stadia; arenas, etc. The device of the present invention, a liquid-holding device of a first liquid, is intended to be sized and dimensioned to the diameter, height, the radius of curvature of the lip, the fluid opening, thickness of the can and the dimensions and shape of the upper lip or flange, etc. of the conventional aluminum beverage can ("the can").

The present invention is intended to be made of thin plastic components and easily shaped by vacuum forming, thermoforming and/or injection molding or similar plastic forming methods (hereinafter collectively referred to as "plastic molding"). Thousands upon thousands of the present device are expected to be made quickly, easily and inexpensively. The devices are preferably assembled from two simple pieces of plastic molded sections which are sealed together to form an internal, liquid-fillable cavity or chamber. Liquid can be provided into the cavity or chambers (often referred to as the "liquid holding pouch") of the device either before sealing of the two pieces together or after the sealing is performed. The device will desirably be made from thin-walled plastic material similar if not identical to that currently used for disposable and ubiquitous coffee cup lids.

Preferably the device or container for the first liquid is made of two simple plastic formed pieces, sealed together one atop the other (preferably by sonic sealing or heat sealing) at their outer rims or edges and at the edges defining their central openings or apertures with a specific cavity or pouch size (for holding the liquid) formed between the pieces. When the top piece and the bottom piece are sealed together, a substantially hollow device is formed (hollow that is before liquid is provided therein). The device is then able to be snap fit onto and around the top portion of a can so that tilting of the can will simultaneously tilt the device.

Each piece provides, in the preferred embodiment, some holding capacity for the overall device. The cavity or chamber of the top piece is in fluid communication with the cavity or chamber of the bottom piece and thus define a single first-liquid holding pouch. The pouch is intended to hold a quantity of the flavoring or characteristic-changing first liquid for admixing with the second liquid of the can. The pieces when sealed together form the pouch, an interior cavity for holding the fluid which is in fluid communication with an opening or aperture of the device. That aperture of the device is manually rotated upon placement on the can so as to be aligned substantially close to the opening of the can. The liquid holding chamber or pouch for the added-in or first liquid is formed by the two thin-walled and plastic pieces forming the device. The walls of the chamber hold the liquid there between. The cavity of one piece of the two-piece device is in fluid communication with the cavity of the other piece of the device to together form the overall pouch or holding container so that the liquid can flow from one piece into the other piece and then out through an opening formed through the wall of the top piece. Preferably, the aperture or opening of the top piece is aligned (by the consumer during attachment of the device to the can) with the conventional pop top or pull tab opening of the can so that when the can and device are opened and simultaneously tilted for dispensing, the second liquid of the can and the first liquid of the device become entrained and the two liquids become thoroughly mixed together while pouring for direct drinking (into the mouth of the user or down the throat) or while pouring into another cup, glass or vessel.

The preferably two pieces of the device (although it is within the contemplation of the inventors for the device to be formable as a single piece of plastic) denominated when assembled together as a first liquid-holding container or "the device," are, after, prior to or simultaneously with joining the pieces together a) filled with the desired primary or first liquid and b) the device is sealed so that liquid can not leak unless and until a closure element (preferably in the form of a small pull tab or adhesive tab covering) is removed from the device's small opening or pour orifice.

Completed devices, preferably pre-filled with liquid, are expected to be sold at retail to a consumer. When the device is installed atop the can (by easy friction/snap fit of the device's upside down U-shaped channel over the upwardly extending top lip or flange of the can) and the pull tab of the aluminum can is opened (before or after the tab or covering of the device is removed) and the device and can tilted together, the mixing and pouring of the two liquids will occur, with the first liquid of the device preferably becoming immediately and efficiently entrained into the outgoing second liquid of the can. Due to the geometry of the device, as described, and the laws of fluid flow of the device and gravity, and the engagement of the device on the can to which it is attached during use—tilting and pouring of the two liquids by tilting and pouring the can and device simultaneously provides a relatively consistent concentration of pouring of the first liquid from the device into and/or along with the second liquid of the can. A smooth, partially entrained and mixed drink comprised of first and second liquids results on a per sip basis.

The preferred embodiment of the present invention is formed and manufactured from thin-walled plastic, similar to that now in commercial use for the manufacture of usable and then disposable lids for Styrofoam and paperboard coffee cups. That plastic material can be vacuum or thermo-formed or injected molded to a specific shape and into two mating pieces for the device. The two pieces can be sonic or heat sealed or otherwise connected together (as by adhesive, glue, a non-toxic sealer, etc.) but preferably after the liquid is first provided into the cavity areas of the pieces or the pieces of the device can be first sealed together and the liquid then provided into the cavity or connected chambers of the device through the same exit aperture or pour opening as for dispensing the first liquid. Alternatively, a different filling aperture can be provided as that used for dispensing. If filling occurs after sealing of the two pieces together and through the pour opening, of course, the aperture through which the device is filled is then closed off with a suitable closure or adhesive tab, and/or made removable when desired for mixing the liquids during use. If liquid filling is through a separate aperture, it must be sealed before shipment and sale.

In the preferred embodiment, the device of the present invention is formed from two pieces of vacuum-formed plastic. Together they form (without the liquid) a substantially hollow liquid holding chamber which is selectively attachable to the top of a can. The first piece or section, the top piece, is basically circular, with an annular, outwardly directed thin rim. It slopes upwardly from the outside rim into a central lip which is the lip-engaging zone for the user when drinking from the can. The central lip extends downwardly to define a central or annular opening which sits atop the top of the can. Stated differently, extending from the rim, upwardly and inwardly, is a coronal section which defines the large central opening. The large central opening is intended to be almost the size as the circular top of the can but should be at least as large as to allow finger access to the pop top or pull tab opening of the tab. The first piece or top piece is thin walled and "open" or hollow towards its bottom. Together with the second piece, the open bottom of the first piece and the open top of the second piece define a liquid holding chamber or pouch. This is where the liquid is maintained before use.

The second or bottom piece of plastic, also vacuum or thermo-formed, possibly injection molded, is manufactured to mate with and be sealed to the first section. It, too, has an annular, outwardly directed thin rim. The rim of the first piece is sealed to the rim of the second piece. It, too, has a central opening. It is about the same size as the central opening of the top piece (only slightly larger in diameter as the central opening of the top piece fits within that of the bottom piece). The two pieces are sealed together to form a device about their outer rims and the central openings. Thus, the outside diameters defining the rims of the two pieces are the same and the diameters of their central openings about the same. The central opening of the bottom piece is, during sealing the pieces together, aligned and beneath the central opening of the coronal section of the first or top piece. The second piece is hollow with its cavity or chamber extending upwardly. Between its outer wall and its inner wall a hollow chamber or pouch area is defined. The inside wall and outside wall are spaced apart, to define the pouch, chamber or liquid holding cavity there between. The inside wall is of a curvature to fit around the outside curved wall of a can. Preferably the can and the inside wall have almost the same curvature but manufacturing, testing and analysis of prototypes has shown that the inside diameter of the second piece is preferably slightly greater than the outside circumferential wall of the can so that a slight space is developed between the device and the can. This allows the device to be more easily snapped onto and held around the can and for ease of removal. The outside wall of this second piece is similarly shaped (curved like the outside of a can) and can be easily held by the user when the can and device are simultaneously tilted for consumption of the contents of the device and can. As a consequence of the small dimensional difference between the diameter of the inside wall and the outside wall of the second piece, a liquid holding chamber, often referred to as the cavity or pouch, i.e., a first liquid holding chamber is developed. Also, the small additional diameter of the device, when held onto the can, allows it to be easily held and, yet, maintains the center of gravity of the device with fluid to be amid the center of the can so that the possibility of accidental tipping over and spillage is minimized. The small additional thickness provided by the device allows for easy gripping of the can and the device, whether one grips the bare metal of the can with a finger extending over the device or if the palm of the hand envelops the device with the finger tips extending beyond the edge of the device and onto the can.

The thin, outside and radially outwardly projecting rims of the first section and the second section are adapted to be sealed together, preferably after liquid is delivered to and held within the pouch or cavity (defined between the inside wall and outside wall) of the second section. The second section is preferably of a specific and relatively small volume capacity (preferably 50 ml) and thus its pouch-like area extends only partially down from its rim to accommodate most of the liquid volume. Of course, the first, top piece or top section of the device is also substantially hollow and, indeed, the two sections define a single, fluid communication chamber for the liquid contained therein. Generally the downward extension of the pouch is only for a portion of the height and for only a portion of the overall circumference of a conventional aluminum can. A small closure, adhesive seal or removable tab initially covers the opening of the first section of the device to hold the first liquid therein until desired use (when the tab is removed from the pour opening). In an alternate embodiment, a small air vent hole is provided to the device at, near or preferably directly opposed to the liquid pour opening to allow for the quick pouring of the device upon tilting as air will then easily enter the cavity/chamber of the device through the air vent hole upon tilting and pouring of liquid out of the device.

Viewed from its top, the second or bottom piece is an open well with a central opening. Viewed from the bottom, the second piece is provided with an annular or inverted U-shaped channel whose inside leg defines the same central opening. The inverted U-shaped channel is of a size, width and profile to accommodate the upwardly extending, encircling top lip, flange or rim of a conventional can. An inwardly directed protrusion to the outside leg of the inverted U-shaped channel is provided for snapping beneath the top of the flange of the can and into a small annular recess at the base of the flange of the can. This holds the device onto the top of the can, when desired. The shape of the channel substantially corresponds to the shape of the upwardly extending lip or flange of a conventional can although the precise dimensions of the flanges may vary from manufacturer to manufacturer. Nevertheless, the resiliency of the legs of the channel of the device is such that it flexes and grips the flange and holds the device to the top of the can. Preferably, however, the flange of a can is snapped into and held by the resiliency and first outward extension around the "fat" part of the flange and then the snap back of the device beneath and around the thinner part of the flange. The dimensions of the inverted U-shaped channel are substantially the same as the dimensions of the lip or flange of the can. The channel, integrally formed with the second piece of the device, is also formed of thin plastic. Its walls are inwardly and/or outwardly resilient so that pushing the device downwardly onto the top of a can will cause the upwardly extending lip, ridge, flange or rim of the can to slide up and into and "snap" into the channel of the second piece, to securely hold the device onto the top of the can. In this condition, the inside and curved wall of the second piece is wrapped around and held close or nearly against the outside curved side wall of the can. Preferably, during attachment of the device to the can, the user will first align the pour opening of the device (closed until used for pouring) with the aperture of the can.

When the device is secured to the can, it is done so in a substantially water tight manner, i.e., fluid being poured through the open top of the can will not drip down the sidewall of the can but, rather, will spill over the interior vertical wall of the coronal section of the device, where the user's mouth is located. There, however, the first liquid of the device will be entrained with the second liquid of the can so that the user receives a mixed drink of the proper concentration, i.e., on a per sip basis, of first and second liquids.

The device is preferably thermo- or vacuum formed or injection molded or otherwise plastic molded from the two thin-walled plastic pieces and then manufactured into a single unit by sealing the first and second pieces together. The assembly is then filled with a first liquid. Of course, the filling and sealing operational steps can be in any order, depending upon machinery, hygiene requirements, and other operational parameters. The closure or adhesive tab is placed over the aperture of the device, either before (if liquid filling is done before or simultaneously with sealing of the pieces together) or just after the liquid filling is completed to effectively seal the device with liquid therein. The first liquid is thus contained and held within the pouch, the chambers or cavity areas of the first and second pieces, defining a single device or unit. The device is thus ready for sale and ultimate usage, as desired.

In the preferred embodiment of the invention, two of the units may be stacked together and sold, with the pouch sections laterally opposing one another and the first sections located away from one another. In this manner, two devices nest so that the coronal sections are faced away from one another with the liquid pouches and exit openings 180 degrees or opposed to one another. This allows a convenient nesting of two of the devices and ensures that the devices occupy a minimum of shelf space in a store. Three of such nested combinations (each with two devices) can be packaged in a cardboard box and sold as a six-pack. They can be sold as six of a single first liquid or as assorted first liquids.

When desired to mix a drink consisting of the bulk being a liquid (a so-called second liquid) of a can and the added-in liquid (so-called first liquid) of the device, a single device is snap fit onto the upwardly extending circular flange of the can. This is done by pushing the device downwardly onto the top of the can. The inverted U-shaped channel of the device will slide over and its walls will slightly first part (by the resiliency of the walls) and then snap around and under the flange of the can, i.e., the downwardly pushing of the device will take place until the top of the inverted U-shaped channel is resting directly upon the top of the upwardly extending flange of the can. When so placed the device is securely held to the can (the flange of the can is within the U-shaped channel of the device), the inside curved wall of the device is located or wrapped around the outside curved wall of the can and the central openings of the top piece and the bottom piece aligned over the top of the can, encircling the pop top tab and the drink opening or aperture of the can. Stated differently, the device is attached to the top of the can and the can is nested into the internal curvature of the device and the two items, can and device, will move (as by tilting for drinking) as a single unit. The fluid opening of the device (with its sealing tab or closure in place) is preferably first aligned with the aperture or pop top or pull tab of the can. Alternatively, after securement of the device to the top of the can, the device can be easily rotated so that the exit opening of the device is aligned with the drink opening or aperture of the can.

When the mixed drink is desired to be enjoyed, the opening of the device is opened (by removing the adhesive tab from the opening (or by sliding a door open, in an alternate embodiment) and the can's drink opening or aperture also unsealed (by removing the door closure by manipulation of the pop top or pull tab). The opening of can and device can be done in either order. With both the can's aperture open and the device's opening also now open, fluid may be poured from the can by normal lifting and tilting the same. When the user tilts the can, for drinking or pouring, the can and the device are simultaneously tilted. The liquid in the device will pour out of the opening of the device as tilting continues just as liquid from the can will pour out of its aperture. The liquid of the device will pour out of the pouch or internal chambers and that liquid, the first liquid, will become entrained into the stream of liquid pouring out of the can, as it, too, flows out as the can and device are simultaneously tilted. The pouring of the liquids of can and device is either into another receptacle or into the user's mouth/throat. The first liquid stream of the device is effectively entrained into the second liquid stream of the can and thus a mixed drink is provided. The size and profile of the pouch and the size and shape of the pour opening of the device are determined so that a substantially consistent concentration or volume of first liquid is provided for a predetermined unit of second liquid flowing from the can. In a preferred embodiment, the can and device will commence pouring their respective liquids at or about the same time and they will both be emptied of their respective liquids at or about the same time. In this manner, substantially consistent concentration of first liquid to second liquid is provided.

In an alternate embodiment, the mixing of the liquids is facilitated by applying gentle finger pressure to the flexible, resilient outside wall of the device which increases the rate of flow of the first liquid from the device and thus increases the concentration of first liquid to second liquid on a per-sip or on an as-poured basis. The measured dose of first liquid provided to the stream of the second liquid of the can, each time the can is tilted, is a function of the size, shape and orientation of the exit or pour opening of the device; the shape and size of the chambers and pouch of the device; the viscosity and chemistry of the first liquid; and the quantity of first liquid provided in the device and that remaining. Depending on the liquids intended to be mixed, the ideal ratio and concentration of first liquid to second liquid might vary and thus adjusting the relationship of the above factors can be used to deliver ideal mixing for each liquid.

After use, the device, according to the preferred embodiment, is removed and easily discarded or recycled or the can and device discarded together (if the can and device, for example, are both formed of thin-walled aluminum). In an alternative embodiment of the present invention, the device can be formed of a more sturdy plastic material which can be washed (even in a dishwasher) and then refilled and reused by the consumer or even returned to the manufacturer, as desired for recycled use. Refilling can be done through the device's opening (in this reusable embodiment of the device, it is provided with a fluid filling doorway which can be opened or selectively closed, which doorway can be the same or distinct from the pour opening of the device).

DETAILED DESCRIPTION OF THE INVENTION, THE PREFERRED EMBODIMENT AND THE DRAWINGS

Figure 1:
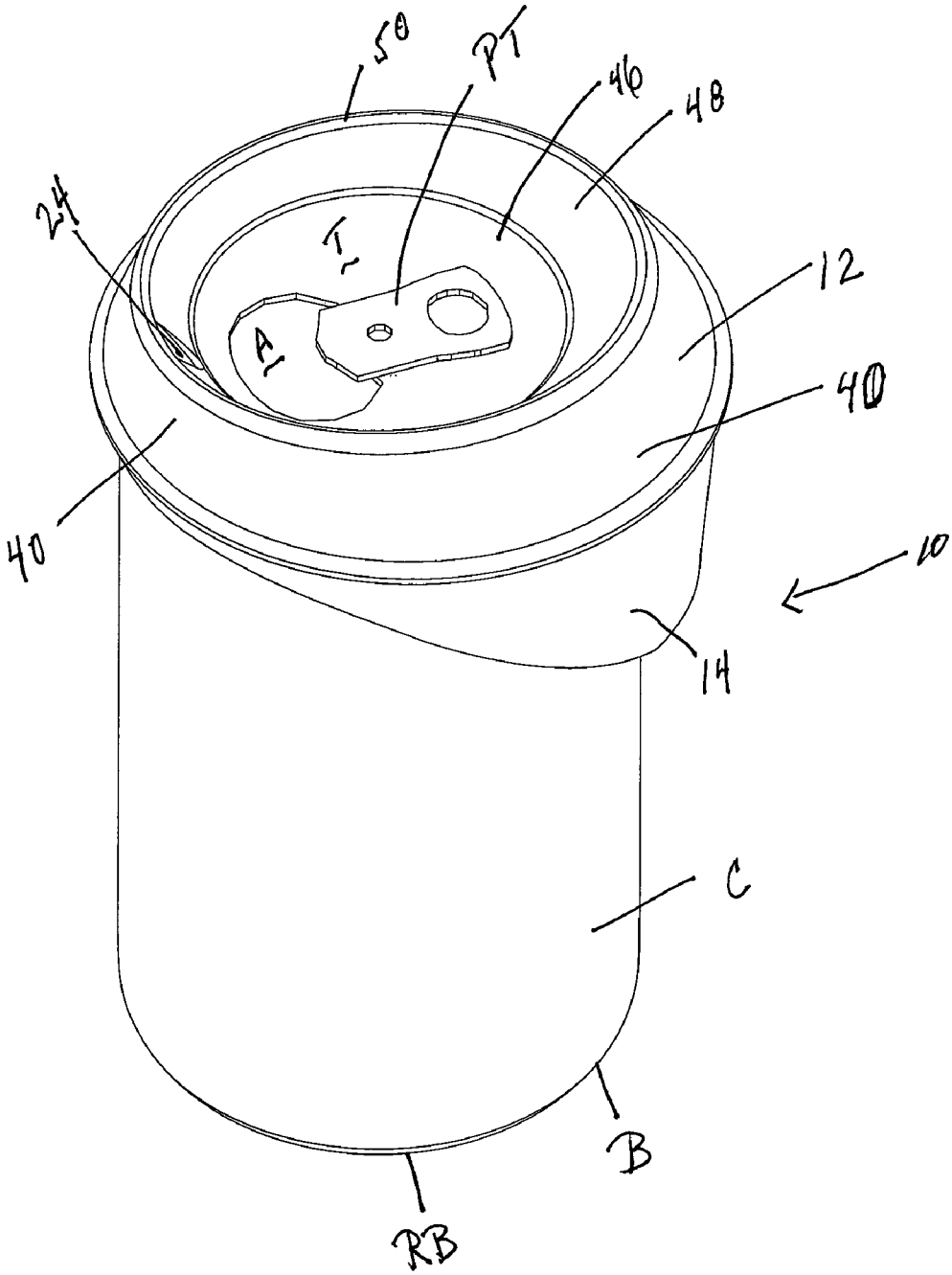
FIG. 1 is a perspective view of the device attached to a standard aluminum can.
Figure 13A:
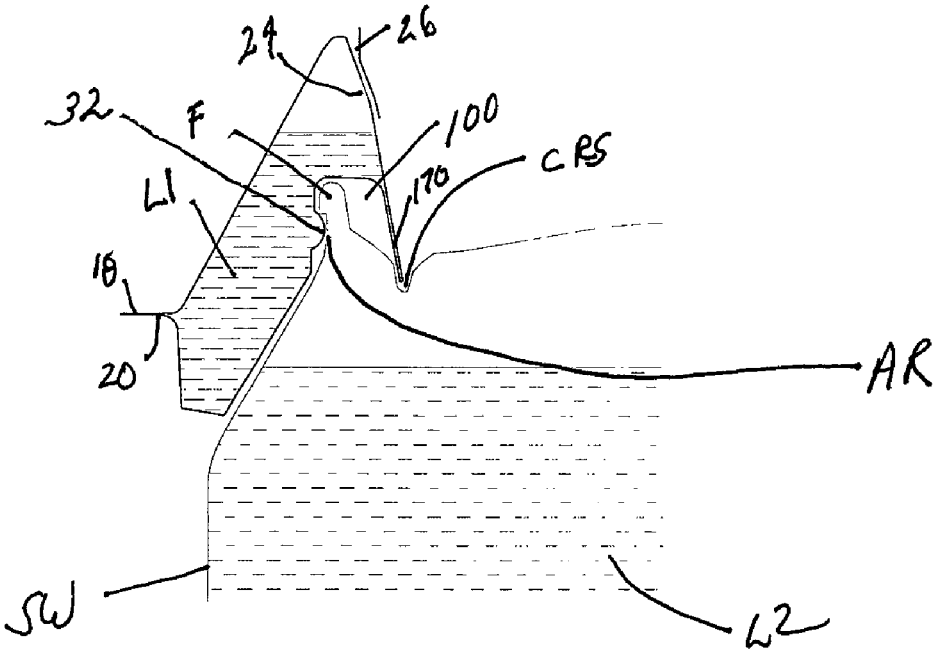
FIG. 13*a* is an enlarged, partial cross-sectional detail showing the preferred mechanism of a resilient snap-fit of the device onto and around the crimped flange or upwardly extending lip of a standard aluminum can.
Figure 13B:
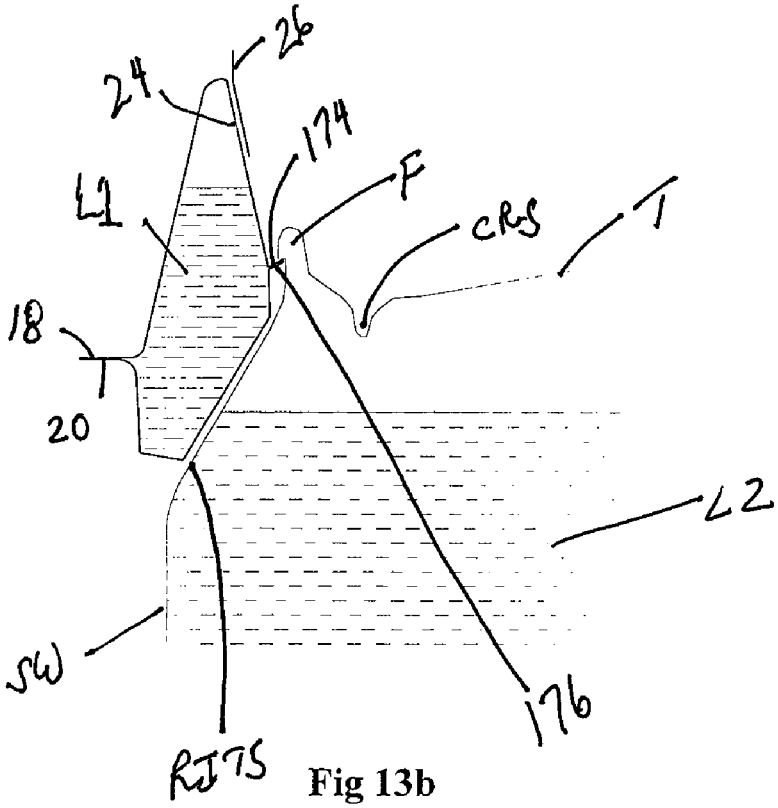
FIG. 13*b* is an enlarged, partial cross-sectional detail showing an alternate mechanism of a snap-fit of the device around the crimped flange or upwardly extending lip of a standard aluminum can.

As best seen in the Figures, the device 10 is a liquid-holding mechanism for selective and proximal attachment to the pouring aperture of a conventional beer or soda can C. Since the device is preferably intended for selective attachment to and removal from a conventional or standard aluminum soda or beer can, to better understand and explain the details of the device, a description of some of the components of the aluminum can is believed needed and desirable. The can C comprises a base B, a cylindrical side wall SW and a top surface T. All are usually made from drawn aluminum, conventionally sold with soda, beer, juice, and other liquids therein. For the purpose of this disclosure, the liquid L2 contained within the can C (see FIGS. 10, 11, 12 *a*-through 12 *e* and FIGS. 13*a* and 13*b*) is referred to as the second liquid L2 while liquid L1 of the device 10 (see FIGS. 10, 11, 12*a*-12 *e*; and 13 *a* and 13 *b*) refers to the first or added-in liquid of the device 10, the liquid intended to change the flavor, characteristic of the second liquid of the can. The top T of the can C is provided with a pull top tab PT (See FIG. 1) which, when bent by a consumer, will open the can C so that fluid or liquid L2 can be poured from the can C through the opening or aperture A. Conventionally, the small, thin aluminum door D of the can C is pushed into the can C when the pull top tab PT is appropriately articulated and thus opens up aperture A of the can C (See FIGS. 1, 11, 12*a* through 12*e*). A flange, lip or upper rim F extends around the top T of the can C and joins the radially-inwardly sloped top section of the side wall SW to the outer perimeter of the top T of the can C. The flange, lip or upper rim F of the can C is useful in manufacture and in also allowing the stacking of cans C, one upon another, as the bases B of such cans C are often provided with a circumferential, downwardly extending rib RB (see FIG. 9*b*) which is slightly smaller in diameter than the inside diameter of the flange, lip or upper rim F. Thus, the rib RB of a first can C will nicely fit and nest within the area defined by the inner wall of flange F (at or above the circumferential recess surface CRS, located radially inside the flange F) of a second can C and, in this manner, a plurality of cans C can be stacked, one upon another. The top T of cans C are provided with a circumferential recess surface CRS, located radially inward from the flange F and projecting downwardly into the interior of the can, as best seen in FIGS. 13*a* and 13*b*, and this circumferential recess surface defines the outer circumference of the majority of the flat surface of the top T. The flange F of a can C is often made by curling and crimping the outside edge of the top T of the can C, i.e., extending it over the top edge of the side wall SW, to thereby form a smooth upper flange F. The flange F is generally of circular shape around the can C, slightly recessed radially inwardly from the outside circumference of the side wall SW of the can C (See FIG. 9*a*).

A pull tab or pop top PT is provided to the top T of these conventional cans C and is connected via a rivet (not shown) to the top T. The pop top tab is engineered to open the aperture A of the can C by pushing the door D into the can as the pop top tab PT is articulated. This opens the can C for dispensing of its liquid L2, as desired. The door D (prior to opening) closes off a scored or aperture A of the can C which is formed into the top T of the can C. Conventionally, when the can C is desirably opened, a user will lift the pop top PT, rapidly bend the same against the fulcrum provided by the rivet, until the door D is separated from the top T of the can (around the score lines defining the perimeter of the door D) until the door D is pushed into the interior of the can C and thus, the aperture A is opened. In this manner, liquid L2 within the can C can be poured out through the door D as the can C is tilted and continued to be tilted. The flow of liquid L2 of the can will continue so long as there is some liquid L2 above the level of the aperture A. This is entirely conventional and believed fully understood by those of ordinary skill in the art. Modifications to the basic design of a conventional can may be made and, yet, the basic invention disclosed herein will function although some modifications may need to be made to the device to accommodate any such changes to the can C.

Figure 2A:
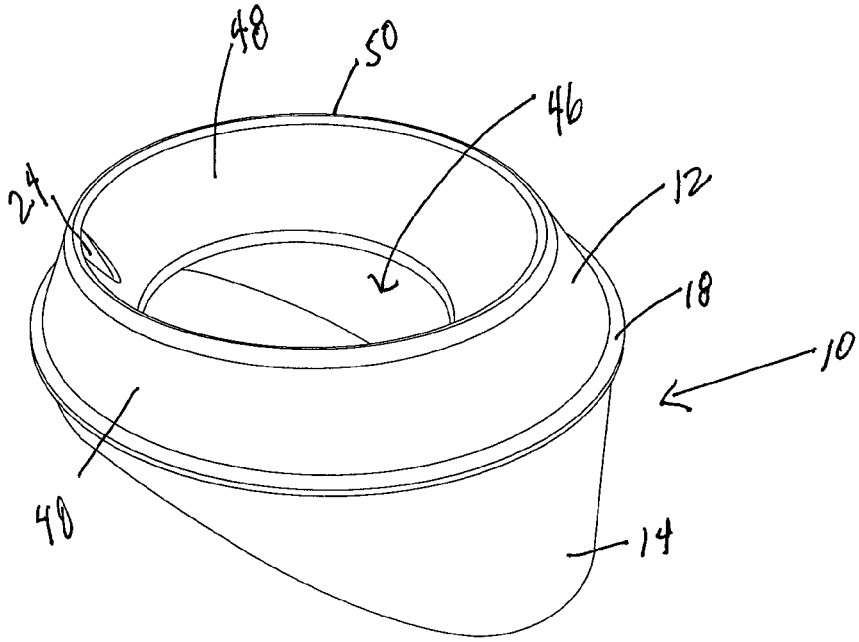
FIG. 2*a* is perspective view of the device from above.
Figure 2B:
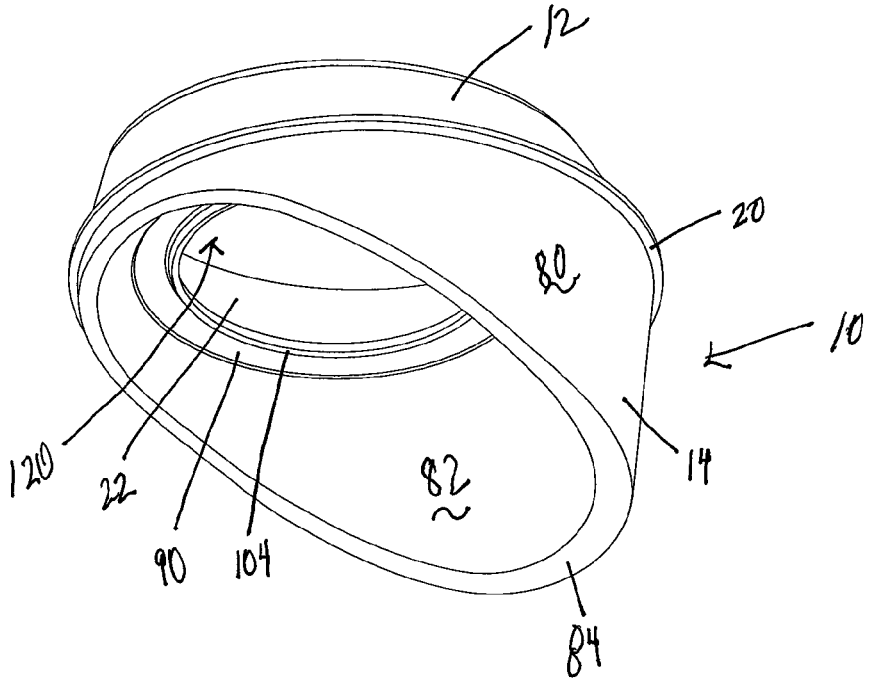
FIG. 2*b* is a perspective view of the device from below.
Figure 8:
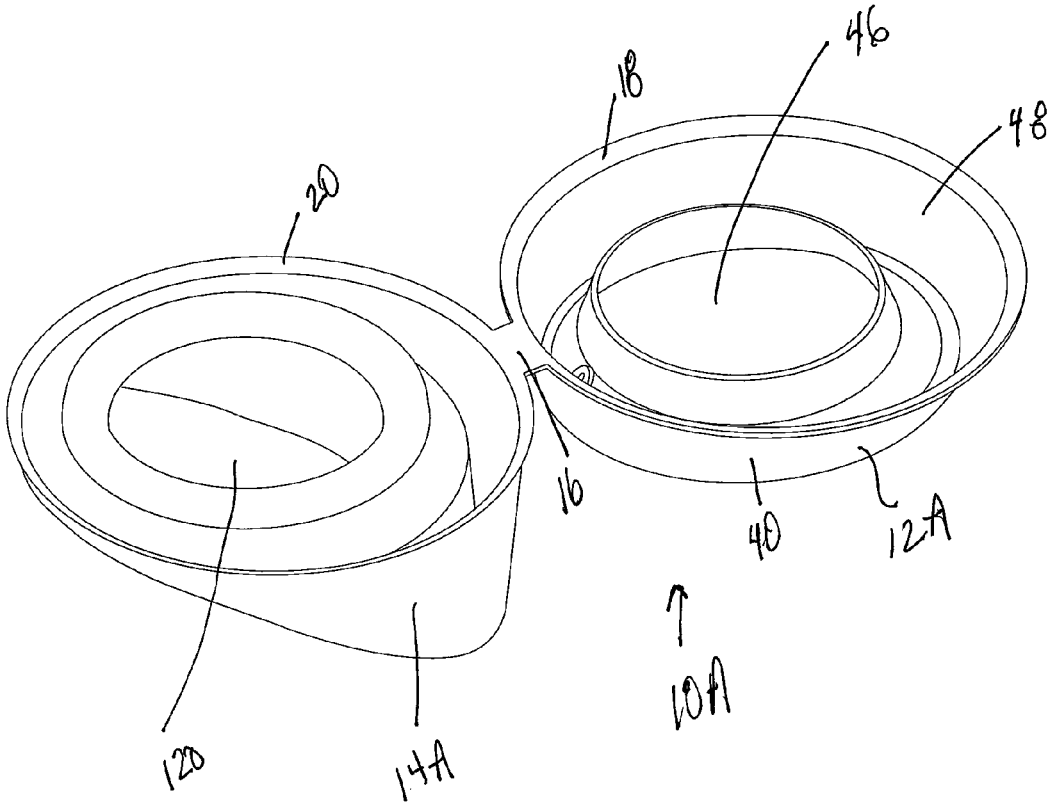
FIG. 8 is a perspective view of an alternate embodiment of the device, showing a possible "clam shell" manufacturing approach instead of the device being formed from two separate pieces (prior to filling with liquid and prior to sealing the pieces together)

The device 10 is preferably made from two thin-walled, plastic pieces 12 and 14. Upper or top piece 12 is vacuum formed, thermo-formed, injection molded or otherwise suitably fabricated and then sealed by sonic sealing, adhesive or other suitable liquid-proof sealing means to lower or bottom piece 14. The plastic is desirably of the same plastic composition and thickness as that used for coffee cup tops of the disposable type, currently sold and distributed throughout Starbucks, Dunkin' Donuts, truck stops, gas stations, and other coffee and convenience shops. Of course, other materials (aluminum like that of the cans, for example) may be used so long as the device is capable of liquid-tight storage of a liquid L1 for some period of time until the device is desirably used. Also, as seen in FIG. 8, a modified device 10A is formed from a single injection molded piece comprised of two sections 12A and 14A (similar in design as top piece 12 and bottom piece 14) connected together by a connecting web element 16. As can be seen in both the embodiments shown in FIG. 5 and that shown in FIG. 8, the first or top piece 12 or 12A is formed to fit and be sonic, heat sealed, adhered, etc. to second or bottom piece 14 or 14A. The top piece 12 is provided with an outside circumferential rim 18 and the bottom piece 14 is provided with an outside circumferential rim 20 (of about the same diameter as rim 18) for the sealing step. Rim 18 of piece 12 or 12A is sealed to rim 20 of piece 14 or 14A (see FIGS. 2*a*; 2*b*; and 5). The central openings of the top and bottom pieces are also sealed or adhered together at the same time as the sealing of the rims to one another.

When desired for use, the device is placed over the can C (see FIG. 1, for example) and the device is preferably snap fit onto the top of the can C by the resiliency of the inverted U-shaped channel 100 of the device (see FIG. 13*a*) cooperating with the flange F of the can C. A user can thus place the filled-with-liquid L1 device 10 over and onto a can C, with inverted U-shaped channel 100 fitting on top of flange F (with annular, inwardly directed protrusion surface 32 of the bottom piece 14 flexing outwardly (as it is pushed down onto the can C) and then snapping back and into and beneath the slight annular recess AR at the base of the flange F, as seen in FIG. 13*a*). The device 10 is thus attached for use to the can C and it can be simply removed by the same resiliency of the device and its annular inwardly directed protrusion surface 32 sliding out and over the flange F of the can C.

The device 10, as seen in the Figures, is assembled from top and bottom pieces 12 and 14, respectively, by sealing of rims 12 and 14 of the top piece 12 to bottom piece 14 and of the edges of the central apertures 46 and 170. Top piece 12, seen in isolation in FIGS. 4, 5 and 6*a* and 6*b*, comprises a basically, conically shaped, thin sheet or piece of continuous plastic. Its base is rim 18. A sloped outer wall 40 flows smoothly inwardly and upwardly from the inside edge of rim 18 and then, at crease 42 extends upwardly to form a top lip surface 44. The top lip surface 44 is an upward extension of the outside surface or outer wall 40 of the top piece, forms a crest 50, and then continues to form and define an inside surface or inner wall 48 on the inside of top piece 12. The bottom edge of the inside surface or inner wall 48 defines an annular opening 46 for the top piece 12. That annular opening 46 is defined at its top by crest 50 and at its bottom by an edge 52. Looking at the bottom of top piece 12 (see FIG. 6*a*) it is substantially a downwardly hollow piece and defines an annular chamber 70 for fluid communication with the chamber 72 of the bottom piece 14 (to be described). Annular chamber 70 is bounded by the inside of outer wall 40; the top lip surface 44 and the inside of the inner wall 48.

Figure 3:
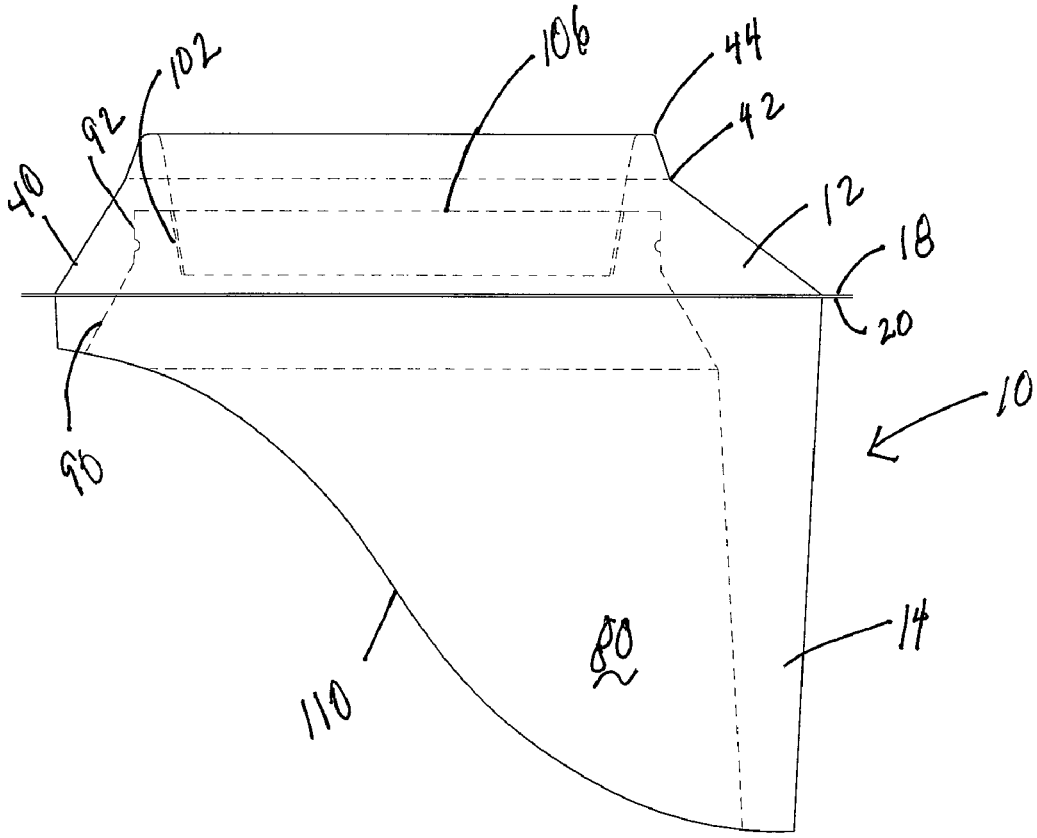
FIG. 3 is a side view of the device with dashed lines showing hidden geometry.

The annular opening 46, seen in FIGS. 3; 4; and 6*a* is off center with respect to circular rim 18. The planes defined by the rim 18 and the crease 42, as well as the crest 50 are parallel, however. Thus, it should be easily appreciated that the off center location of the annular opening 46 with respect to the rim 18 is a function of the surface length of outside surface or outer wall 40 or, stated differently, the distance between the rim 18 and the crease 42 as outer wall 40 extends around the top piece 12, changes. This can be seen in FIG. 6*a* where the annular opening 46 is closer to outer wall 40 on the left of the drawing than it is to the outer wall 40 on the right side. In the preferred embodiment, the pour opening 24 is located on the inside portion of the top lip surface 44 i.e., on the interior circumferential surface or on and through near-vertical wall 48, at a point proximal to where the annular opening is close to the rim 18.

Figure 4:
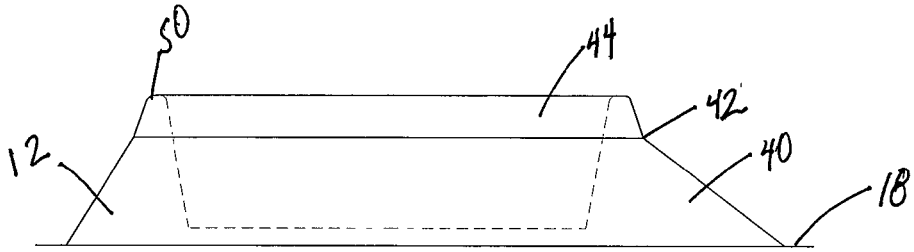
FIG. 4 is an exploded side view of the device showing the top and bottom pieces prior to filling with liquid and prior to sealing assembly.
Figure 4:
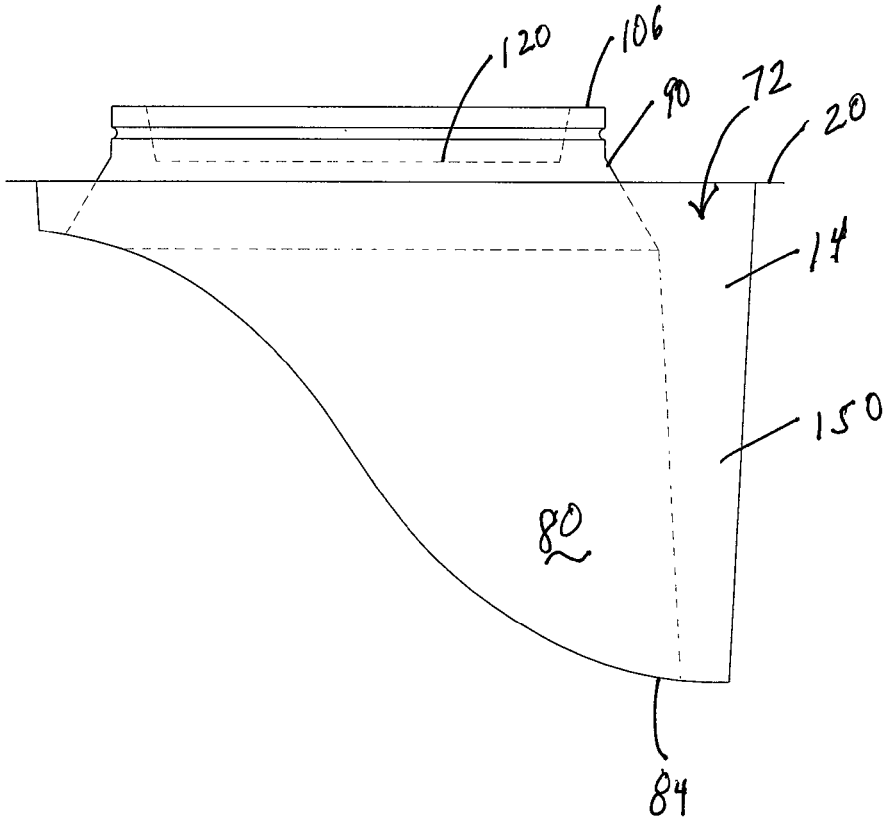
Figure 5:
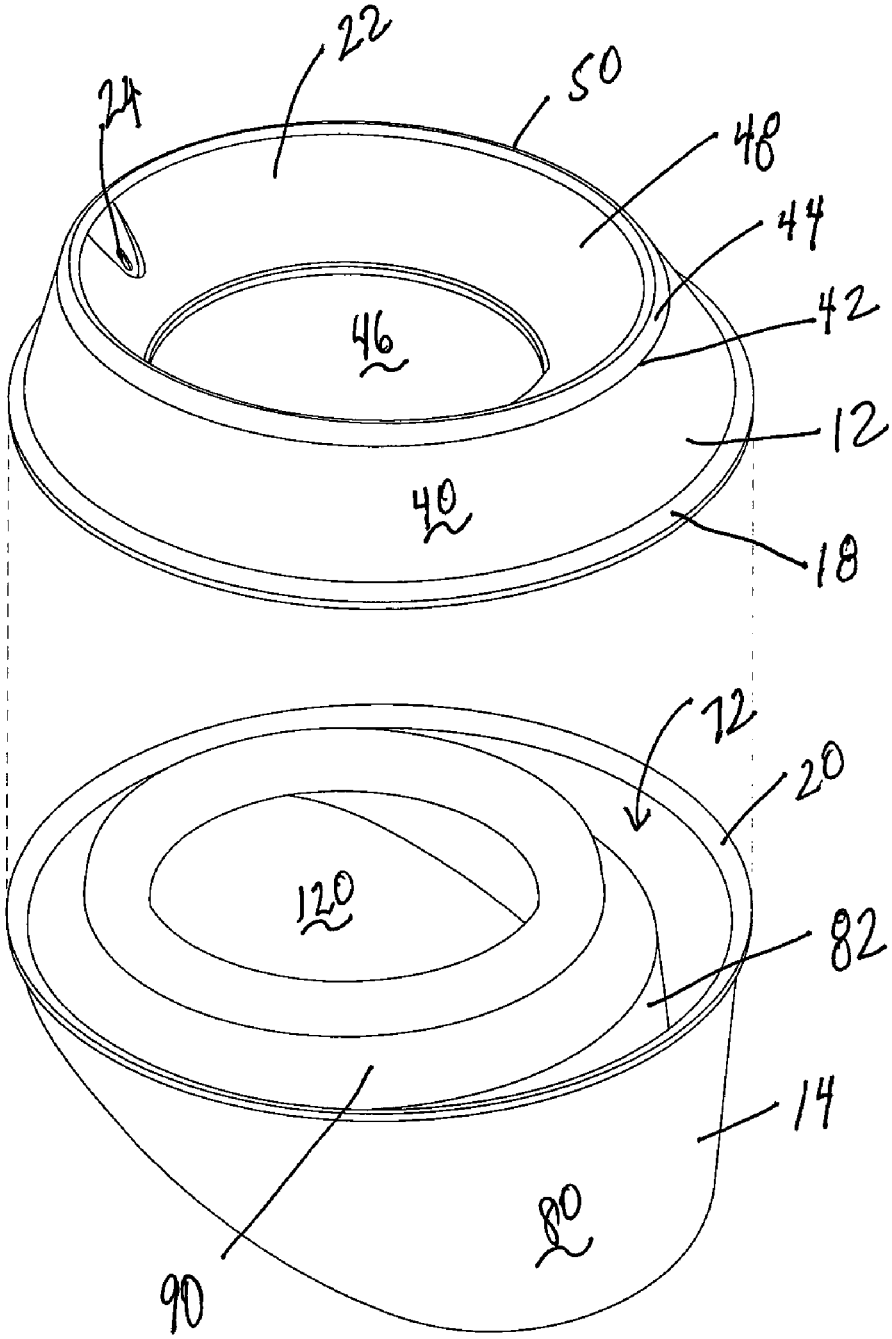
FIG. 5 is an exploded perspective view of the device from above showing the top and bottom pieces, again prior to filling with liquid and prior to sealing assembly.
Figure 6A:
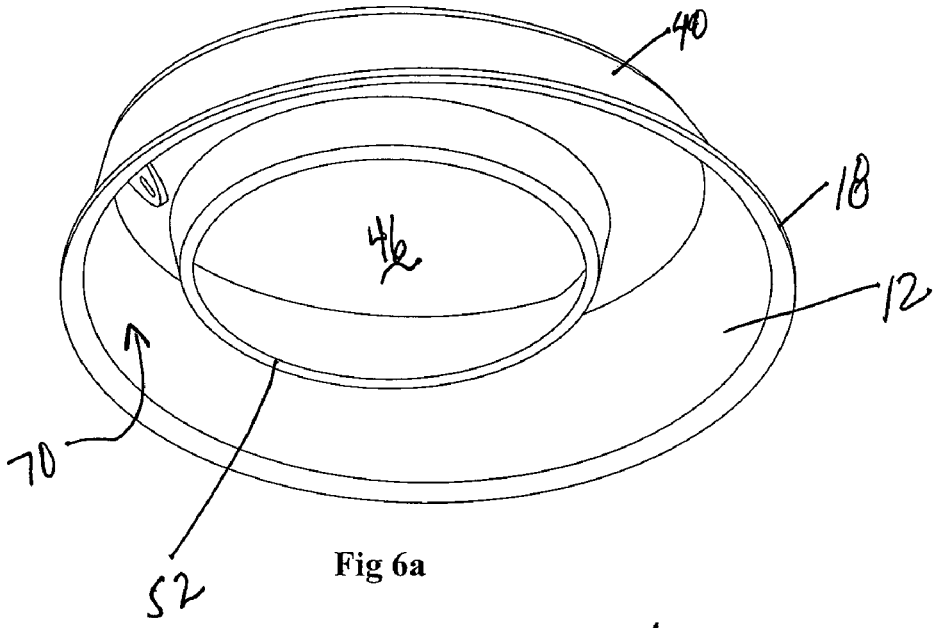
FIG. 6*a* is a bottom perspective view of the top piece of the device.
Figure 6B:
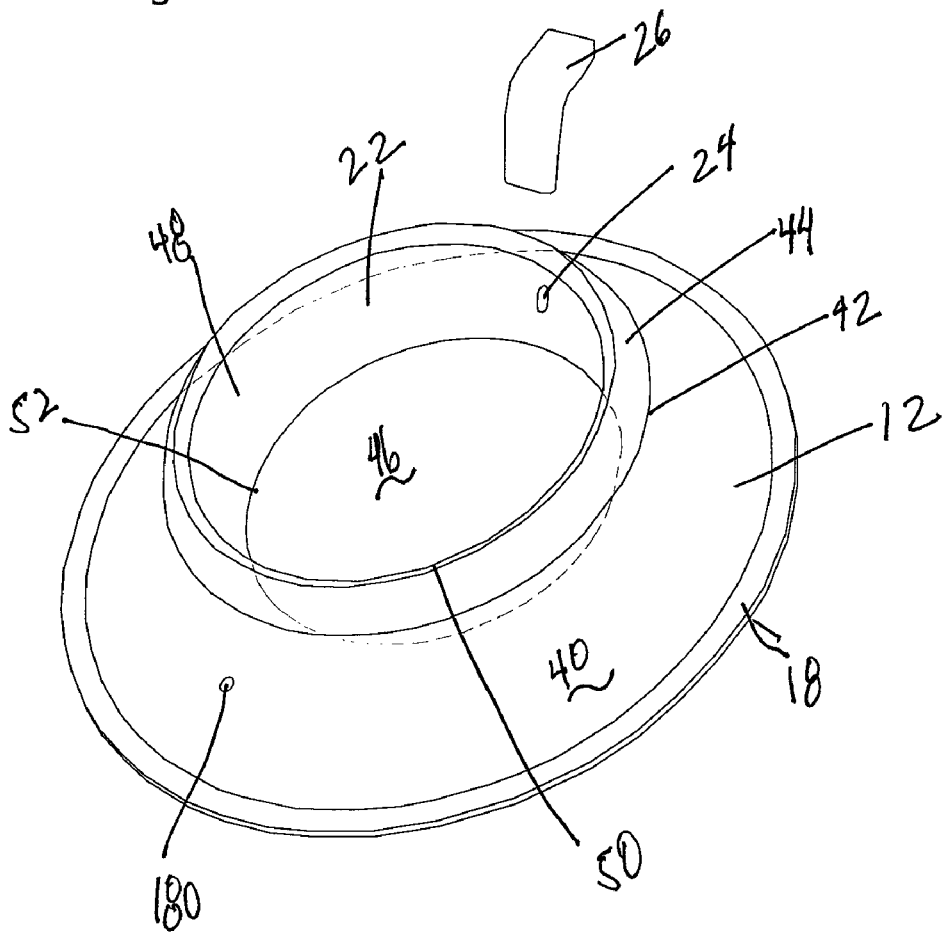
FIG. 6*b* is an exploded top perspective view of the top piece of the device and a covering tab for the pour opening of the top piece (also showing the air vent hole)
Figure 7:
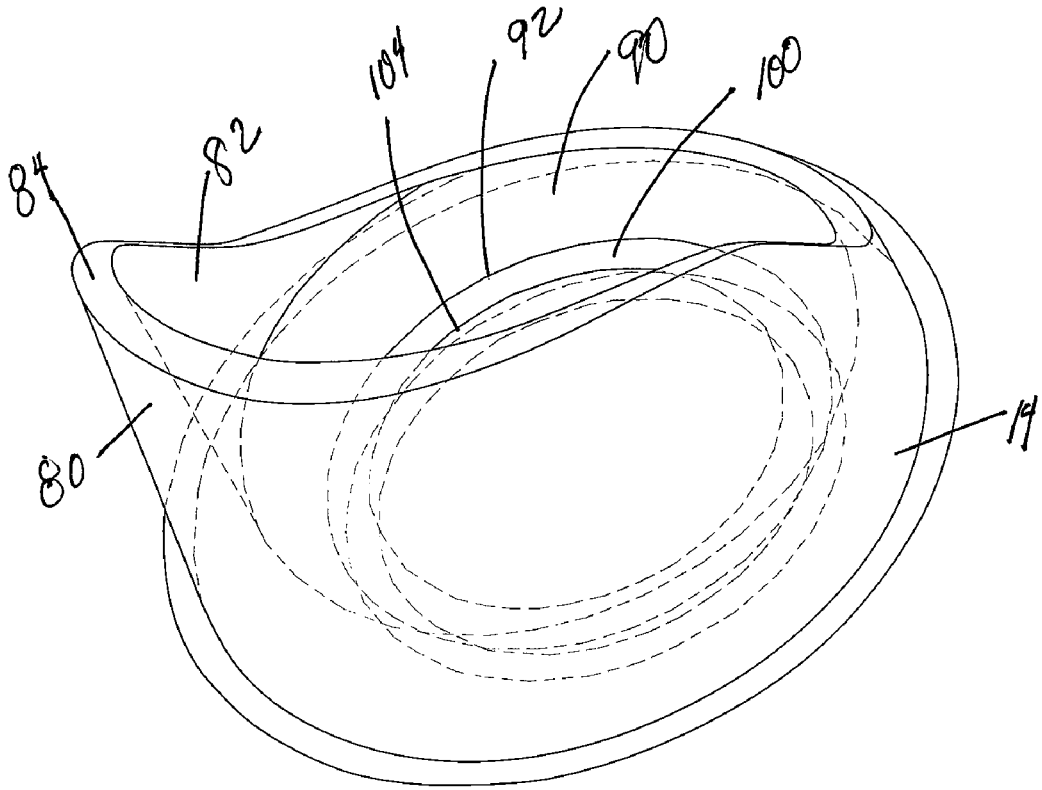
FIG. 7 is a bottom perspective view of the bottom piece of the device.

The bottom piece 14, seen separately in FIGS. 4, 5, and 7, comprises a basically yet partially cylindrically-shaped, thin sheet or piece of plastic which is hollow towards its top. Its outside edge is defined by laterally extending rim 20. Extending downwardly from the outside rim 20 is an outside, smooth wall 80 which is substantially the same radius of curvature but a different diameter as the outside side wall SW of the can C. An inside curved wall 82 is substantially parallel to yet located inside of outside, smooth wall 80. It is substantially the same radius of curvature of the sidewall SW of a can C and will be close to the sidewall SW of the can C when the device is placed over the can. Its surface shape thus matches the shape and dimension of the can's sidewall. Correspondingly, the outside, smooth wall 80 is similarly shaped and yet spaced from the inside curved wall to define a liquid holding chamber there between. A bottom edge 84 connects outside, smooth wall 80 and inside curved wall 82. As seen in the drawings, the curvature of the inside curved wall 82 is basically the same as the curvature and dimension of the side wall SW of a can C so that the device 10, when placed on a can C will have inside curved wall 82 closely adjacent and partially wrapping around the side wall SW of the can C. The distance between outside, smooth wall 80 and inside curved wall 82 slightly varies from the top of the bottom piece 14 to the bottom edge 84 (see FIG. 4). Stated differently, the chamber is tapered from the top-located rim 20 of the second piece 14 to the bottom edge 84. Outside, smooth wall 80 is farther from inside curved wall 82 near the rim 20 than at the bottom edge 84. Preferably, the inside curved wall 82 is a substantially vertical wall surface about the center axis of the bottom piece 12 and the outside smooth wall 80 is greater in diameter near the top or rim 20 than at the bottom edge 84.

As seen in the drawings, the outside, smooth wall 80 and the inside curved wall 82, along with the bottom edge 84 define a chamber 72 there between which is open towards the rim 20. The chamber 72 of the bottom piece 12 and the chamber 70 of top piece 12 are in fluid communication (when the pieces sealed together) so that a liquid L1 contained within chamber 72 will easily flow into chamber 70 when the device is suitable tilted or tipped for pouring along with the can C. As seen in FIGS. 3, 4, and 9*b*, the side profile of outside, smooth wall 80 and inside curved wall 82 defines a sine-like curve 110 (extending from 180 degrees to 360 degrees only). Thus, it can be seen that the device 10 and the bottom piece 14 do not extend, for the height of the bottom piece 14, entirely around the can C. Rather, the bottom piece is of small height on one side opposite the pour opening 24 and of a larger height, about 50% of the overall height of the can C, on its opposite side. This configuration allows for the substantially constant concentration or flow of liquid L1 into a mixed drink formed from the flow of liquid L2 from the contents of the can C (as will be more fully described).

At the top of the inside curved wall 82 is a radially-decreasing and inwardly directed wall portion 90. It merges into a basically vertical section of plastic material which defines, at its top, a first wall section or leg 92 of an inverted and U-shaped channel 100. The wall continues across the top 106 of the inverted U-shaped channel 100 and forms an inwardly, radius decreasing and downwardly extending second leg 102 of the inverted and U-shaped channel 100. The top 106 of the inverted and U-shaped channel 100 will, when the device 10 is pushed onto the can C, be on top of the flange F of the can C. One leg 92 of the inverted and U-shaped channel 100 will be on the inside of the flange F and the other leg 102 will be on the outside of the flange F. A bottom edge 104 is located at the end of the second leg 102 of the inverted and U-shaped channel 100. Bottom edge 104 defines the annular opening or aperture 120 of the bottom piece. That aperture 120 is substantially the same diameter as annular opening 46 of the top piece 12. During sealing of upper piece 12 to bottom piece 14 annular opening 46 fits within and is sealed to aperture 120 of bottom piece 14. The edges of the annular opening 46 and aperture 120 are sealed together as the rims 18 and 20 are sealed together to define a large liquid holding pouch, comprised of the hollow chambers of the top and the bottom pieces, 12 and 14, respectively.

As can be seen in the drawings, the aperture 120 is off center with respect to rim 20 and, indeed, is located closer to the rim or side of the bottom piece 14 opposite to the large sections of outside smooth wall 80 and inside curved wall 82. The amount of offset with respect to the rim 20 is the same as the amount of offset of annular opening 46 from rim 18 of top piece 12. The distance between the legs 92 and 102 of the inverted U-shaped channel 100 is such that the edge 104 or the top of the channel 100 will sit upon the flange F (and its top edge) when the device is snapped onto the can C. The snap fit aspect of the device serves to ensure that the device stays on the can until desirably removed. The snap fit is facilitated by the resiliency of the aperture 120 and the annular opening 46, along with the size and shape of the inverted U-shaped channel 100, as it cooperates with the flange F, the annular recess AR of the flange, the circumferential recess surface CRS, etc. of the can C.

Stated differently, looking at the bottom piece 14 from the top, it is comprised of a first center-located section that fits over the top of a can C with the aperture 120 located on the can's top T. The edge 104 of the aperture 120 will fit in the circumferential recess surface CRS or annular groove of the can (see FIG. 13*a*), the top 106 of the inverted U-shaped channel 100 will sit on top of the flange F, and the first leg 90 will sit on the outside of the flange F of the can C. The wall portion 90 of the bottom piece 14 will lay on the radially inward tapering section RITS (see FIG. 13*b* and FIG. 9*b*) of the can C. It will be appreciated that the top lip surface 44 of the top piece 12 is elevated above the inverted and U-shaped channel 100 and thus, when the device 10 is on the can C, the top lip is elevated above the flange, by the approximate distance of the height of the inner wall 48.

When attached to a can C, the device 10 will have its inside curved wall 82 extending downwardly on the outside of the can and yet it is located proximal to the top of the side wall SW of the can C. Preferably, the user will, upon desired use, first align the pour opening 24 and its covering tab 26 (a visual alignment indicator can be provided although the presence of the covering tab is a visual alignment indicator) such that the pour opening 24 is close to the door D and aperture A of the can C. The top T, the pull top tab PT, the door D and the aperture A (defined by the removal of the door D) are all finger-accessible and visible through the aperture 120 of the bottom piece 14 and the aligned (and sealed to it) annular opening 46 of the top piece 12.

When filled with liquid L1 and the device 10 sealed about the outer rims 18 and 20, annual opening 46 will be just located within circular aperture 120 and they will be simultaneously sealed thereto. This, then, defines a single liquid holding chamber or pouch 150, defined as the chamber 70 of top piece 12 and chamber 72 of bottom piece 14. Thus, when the device is placed onto a can C (see FIGS. 5, 6*a*, 6*b*, 9*a* and 9*b*) the aperture 120 and annular opening 46 lie over the top surface T of the can C and are centrally located above the can C and, yet, the majority of the volume of the liquid L1 and the liquid holding pouch 150 hang down the side wall SW of the can C. Yet, as a consequence of the small distance between the inside of the inside curved wall and the sidewall SW of the can C and the small dimension of the bottom edge 84 (and the only slightly greater diameter dimension to the outside smooth wall 80, the liquid L1 and the device 10 are very close to the center of gravity of the can C. Thus, when the device is located on the can C, there is little additional tendency for accidental tipping over and liquid spillage as the weight of the device and the liquid L1 are close to the center of gravity (the vertical axis) of the can C upon which the device is located.

In one embodiment of the invention, the inverted U-shaped channel 100 is adapted to snap over and resiliently flex around and over, then grab beneath the annular recess AR of the flange F of the can C. In this embodiment, shown in FIG. 13*a*, pushing downwardly on the device 10 over the top of the can C will force the annular inwardly directed protrusion surface 32 of one leg of the inverted and U-shaped channel 100, first outwardly over the flange until further pushing downwardly causes the annularly inwardly directed protrusion surface 32 to snap beneath the flange F and into engagement with the annular recess AR of the flange F (located just below the top of the flange). This can occur because of the thin wall and resilient nature of the materials used for the device. Also, as the device 10 is inserted onto the top of a can C, the annular opening 46 of the top piece 12 and the aperture 120 of the bottom piece 14, sealed together as a single edge 170, will locate in the circumferential recess surface CRS of the can C. This, too, is seen in FIG. 13*a*. Either the inside edge flexes to allow the protrusion surface 32 to cam over the flange and then into the annular recess AR or the edge 170 flexes or both but the device is resilient so as to allow a snap on and snap off, as desired, and when snapped onto a can C, the inverted and U-shaped channel 100 is gripped onto the flange F, and preferably, the edge 170 is located within the circumferential recess surface CRS of the top T of the can C.

Alternatively, as seen in FIG. 13*b*, no inverted U-shaped channel is provided for securing the device to the flange but another similar and resilient mechanism is provided. As seen in FIG. 13*b*, the top piece 12 and the bottom piece 14 are sealed together at rims 18 and 20, respectively, on the outside edges of the device 10, and, on the inside of the annular opening 46 and the aperture 120, at meeting edges 174 and 176, forming a common edge 180 (not numbered). The resiliency of the device, at that common edge 180, a consequence of the material (thin walled plastic) a slight redesign of the aperture 120 of the bottom piece 14 and the annular opening 46 of the top piece, cooperatively allow the device to be snapped onto the top T of the can C and still provide a substantially liquid seal to the device around the flange F. Here, the edge 180, formed from the edges 174 and 176 of the top and bottom pieces 12 and 14, respectively, is flexed around the outside of the flange (because the central aperture and opening allow for the resilient flexing) and then hold the device to the outside of the flange F.

According to another embodiment of the present invention, the pour opening 24 for the device 10 is initially large for facilitating a quick filling there through with the first liquid L1 (after the top piece 12 and bottom piece 14 are first sealed together. Then, after the device is filled with the first liquid, a smaller sized aperture, provided in and through a small layer of plastic material (with one side having adhesive) is placed over the relatively larger filling aperture to define the size of pour opening 24. A sealing tab 26A (not shown) is then placed over the now appropriately smaller sized pour opening 24. Thus, the exit or pour opening 24 for the first fluid L1 is smaller than the filling site and aperture used for providing liquid L1 into the pouch 150, formed by the chamber 70 of the top piece 12 and the chamber 72 of the bottom piece 14 of the device 10. In this manner, a single mold for the top section and the filling aperture for putting liquid L1 into the pouch 150 can be machined and provided and the exit aperture or pour opening 24 can be easily changed (depending upon the nature and desired concentration of the first liquid L1 to be entrained with the second liquid L2 of the can) by merely changing the size of the pour opening 24, which is through the small plastic sheet which covers the filling aperture.

In one embodiment, there can also be provided an air or vent hole 180 (see FIG. 6*b*) preferably opposite to the pour opening 24. A separate seal (removable tab) can be provided to the air or vent hole or a laterally extended and thus enlarged single seal in the form of an adhesive removable tab can be provided which will cover both pour opening 24 and air vent hole 180. The air or vent hole 180 will allow for a smooth, continuous flow of first liquid L1 when the can C and device 10 are tilted as air will replace the lost first liquid L1 volume. If no air hole is provided, the user may need to squeeze the soft walls of the device to dispense the first liquid into the stream of the second liquid flowing from the can. This allows the user to personalize the flavoring to his/her own desire. In any event, vent hole or not, the outside, smooth wall 80 can be depressed by the user to selectively force additional liquid L1 out of the device. That outside, smooth wall 80 is intended to be resilient and easily depressed by finger pressure.

Figure 14:
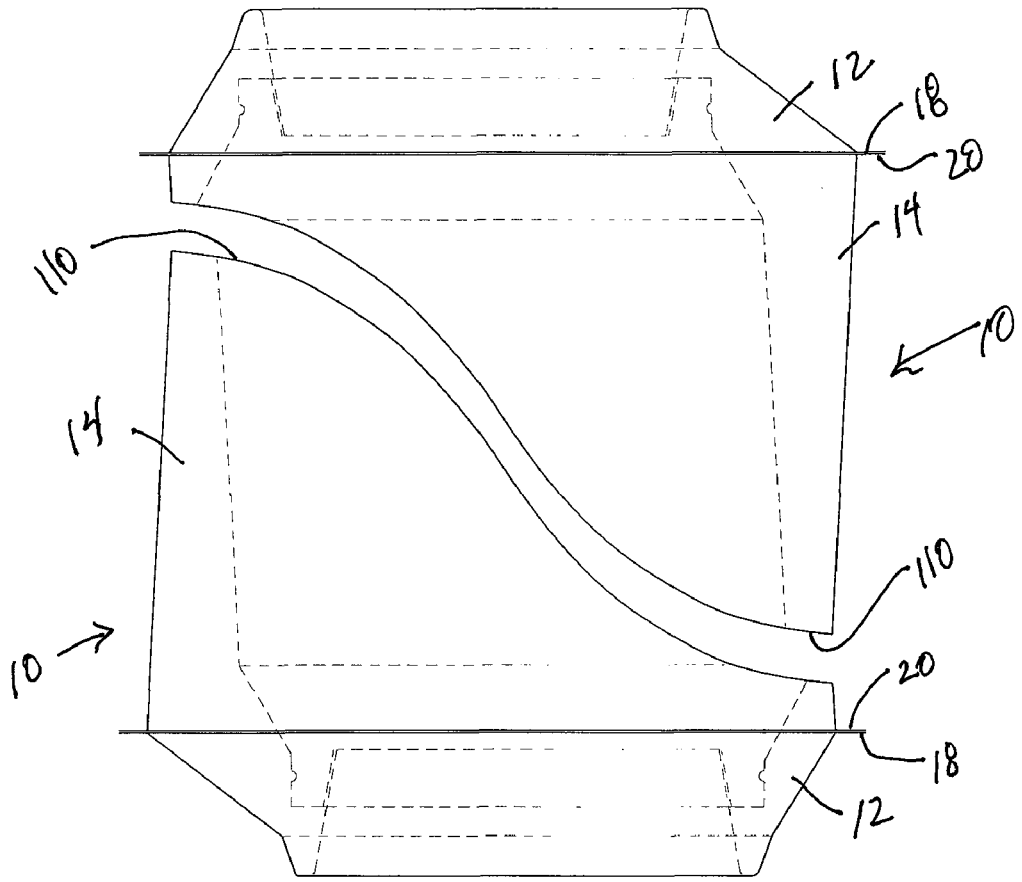
FIG. 14 is an exploded and side view showing two devices, inverted and rotated with respect to one another and thus showing nesting of two devices for economy of shipping containers and retail shelf space for the devices.

FIG. 14 shows how the device 10 can be nested with an identically dimensioned device for conservation of packaging and shelf space. Basically, since the devices are sealed with liquid L1 until desirably used on the top of a can, they are liquid containers by themselves. When suitably sealed they can be tilted and rotated, as desired, without fear of spillage. One device 10 is shown in its upright position in FIG. 14. Another identical device 10 is shown inverted in FIG. 14. The two devices 10 nest by the curvature of sine like curve 110 of the right-side up device fitting into the curvature of sine like curve 110 of the second or an inverted device 110 (as can be easily seen). This requires a relative rotation, too, of one such device about its central vertical axis with respect to the other device so that the pouches 150 are opposed to one another, as are the pour openings 24. So, a simple inversion and rotation allows two of such devices 10 to be conveniently nested for economy of storage.

Figure 15:
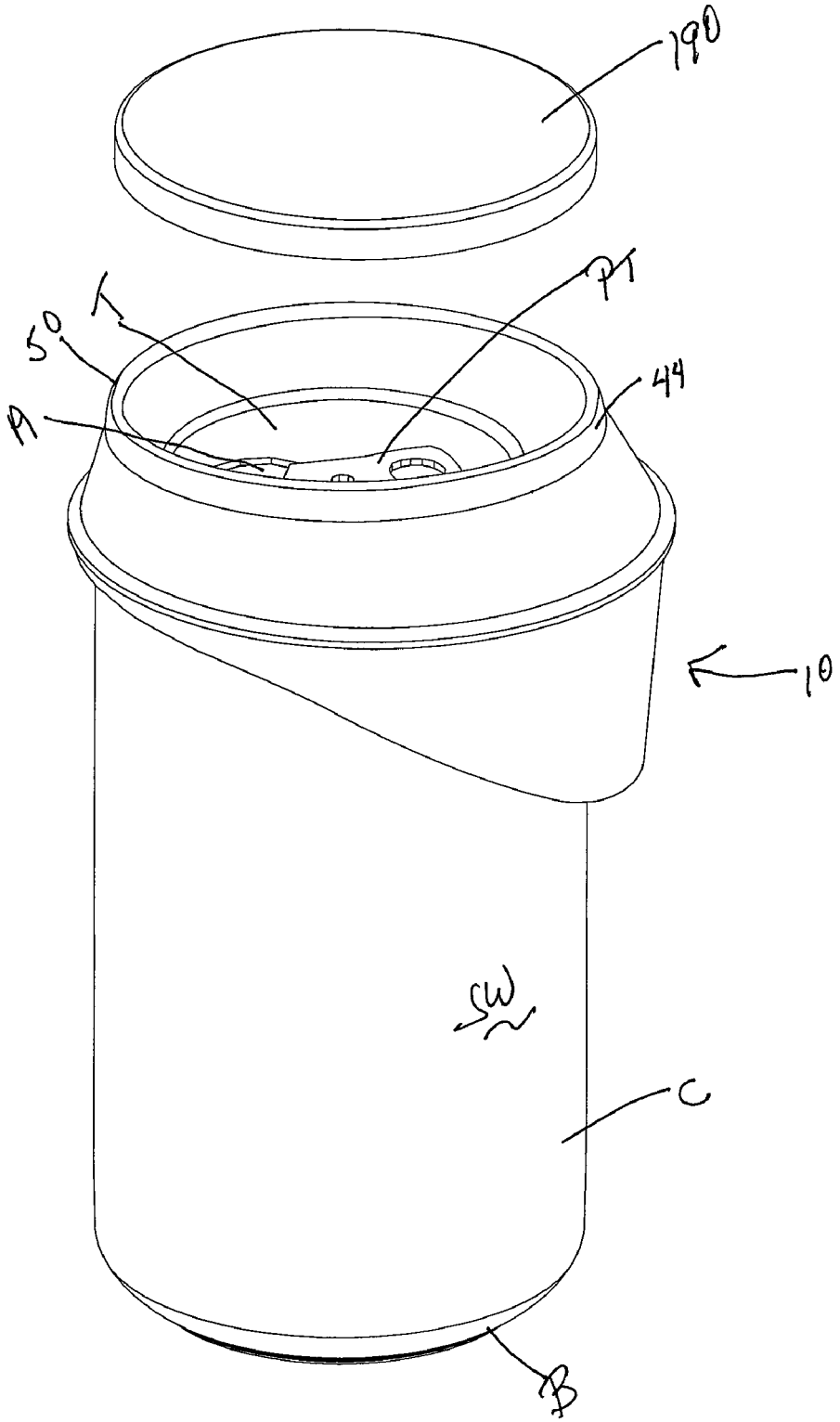
FIG. 15 is an exploded perspective view of the device with a removable friction-fit lid.

FIG. 15 shows an alternate feature to be provided to the invention. Here, a cap 190 can be used to temporarily close off and reseal the aperture A of the can and the pour opening 24 of the device 10. The cap 190 is preferably provided with internal, downwardly extending screw threads 192 (not shown) which mate with external screw threads 194 on the outside of the top lip surface 44 of the device 10. Alternatively, the cap can frictionally fit over the outside of the top lip surface 44.

In an alternative embodiment of the invention, the device 10 can be made from thin-walled aluminum sheet. That material would have sufficient liquid holding capacity (without leakage) and resilience for use with a can C. Also, the use of either thin-walled plastic material or aluminum for the device will allow the user to easily hold the device and tilt the same for drinking (the weight is insignificant) and, as desired, the user can push on the outside wall of the pouch, increase its internal pressure, and thus force additional liquid L1 out of the device. Thus, a user can modify the taste and consistency/concentration of the liquids L1 and L2, as desired. If an aluminum material is used for the device, recycling of the device and the can will simply allow a user to throw both into the same recycling container, in contrast to the situation where the device is made of plastic and the can of aluminum, which would necessitate a separation, after use, into separate recycling containers, one for metallic cans, the other for plastic-based items.

In the preferred embodiment the volume defined by the pouch is about 50 ml. However, of course, more or less fluid volume can be provided and the dimensions of the device either maintained (if smaller volume is desired of liquid L1 the manufacturer merely fills the device with less liquid L1) or the size of the pouch can be extended downwardly along the sidewall SW of the can (if additional liquid L1 is desired). One important aspect of the invention, however, is that it can be used with a variety of can sizes, e.g., 4 ounces; 8 ounces; 8.3 ounces; 12 ounces and 16 ounces, for example, as those cans generally have the same diameters and dimensioned flange, opening, basic shape, etc., with the difference in capacity of liquid L2 being primarily in the height of the can. Thus, a single device and molds for making the device (as well as liquid filling machines) can be made for a variety of can capacities.

Figure 9A:
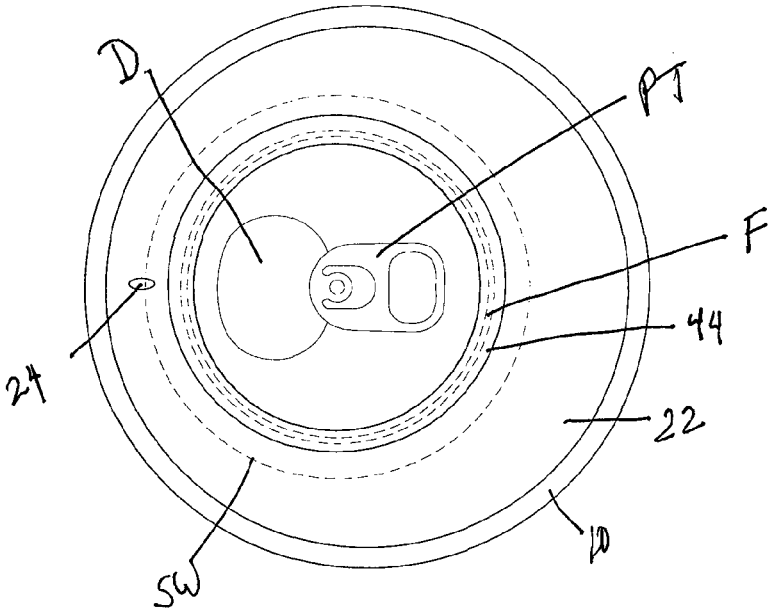
FIG. 9*a* is a top plan view of the device attached to a standard aluminum can.
Figure 9B:
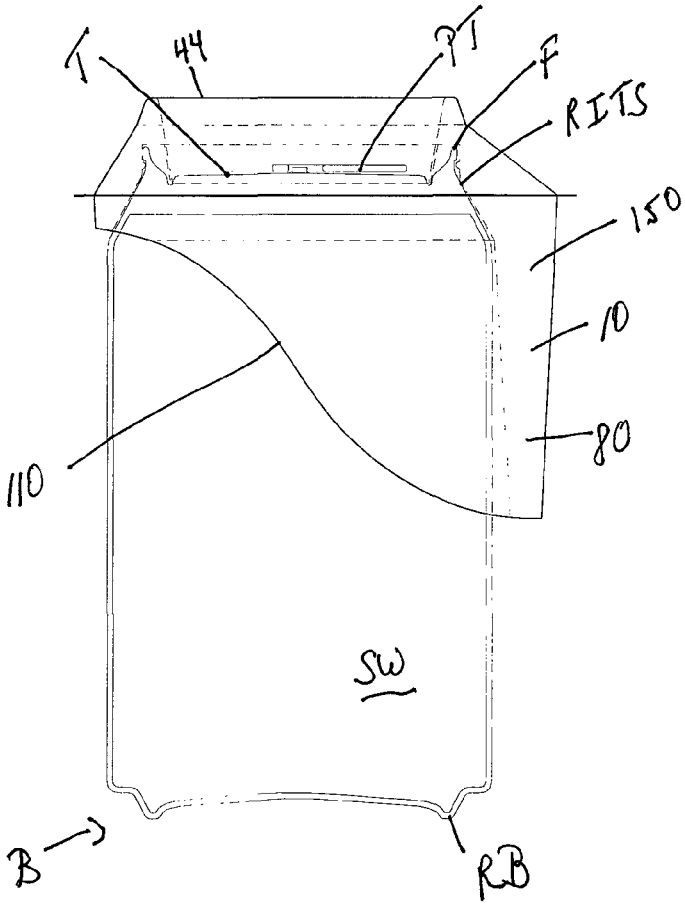
FIG. 9*b* is a side elevational view of the device attached to a standard aluminum can.
Figure 10:
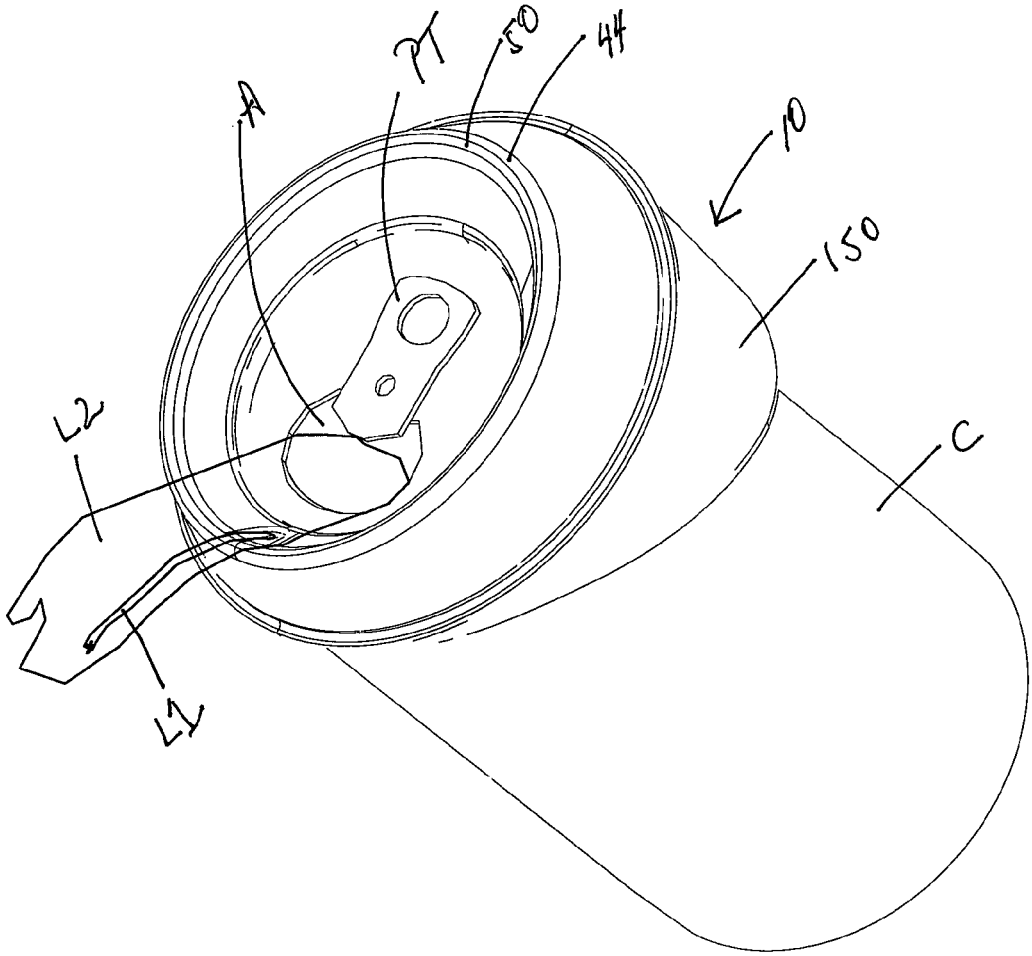
FIG. 10 is a perspective view of the device attached to a standard aluminum can as the two are simultaneously tilted for liquid flow (pouring or drinking) and showing the entrainment of the liquid of the device into the stream of liquid flowing from the can for a mixed drink.

In use, the device 10 may easily be snap fit onto a can C (see FIGS. 9*a* and 9*b*). The user needs to rotate the device so that the pour opening 24 (initially covered by tab 26) is near or aligned with the door D of the can C. This can be done before snapping the device onto the can or after. Then, the user will remove, when drinking is first desired of a mixed drink of liquids L1 and L2, provided by device 10 and can C, respectively, the tab 26 and either before or after also remove, in conventional manner, the door D from the can, thereby exposing the aperture A of the can. The tab 26 for the device 10 and the pull top tap PT for the can C are both accessible by the user through the center annular opening 46 and aperture 120 of the device. When a mixed drink is desired to be imbibed, the can C may be tilted for pouring its contents L2 out through its aperture A but, as should be readily appreciated, any tilting and pouring of the can C will cause the liquid L1 of the device 10 to simultaneously pour out of its pour opening 24. As seen in FIG. 10, the pouring or tilting of can C and device 10 results in liquid L2 and liquid L1 flowing out of their respective chambers and mixing together to form a mixed drink.

The design of the chambers and pouch for holding the liquid L1 and pouring the same as the can and device are simultaneously tilted contributes to the uniform mixing of liquid L1 with liquid L2 on a per sip or per tilt/pour bases. The first liquid is distributed in greater amount farther from the pour opening since the aperture is opposed to the pouch. This promotes the formation of a reservoir of liquid above the pour opening. In the preferred embodiment, this is achieved by an angled bottom wall (i.e., the pouch is deeper opposite to the pour opening and shallower at the opening). However, it is contemplated by the inventors that this distribution could also be achieved by adjusting the widthwise extension of the pouch such that it is wider or extends away from the sidewall SW more of the can C at the location opposite the pour opening and narrower as the pouch get closer to the pour opening.

Figure 11:
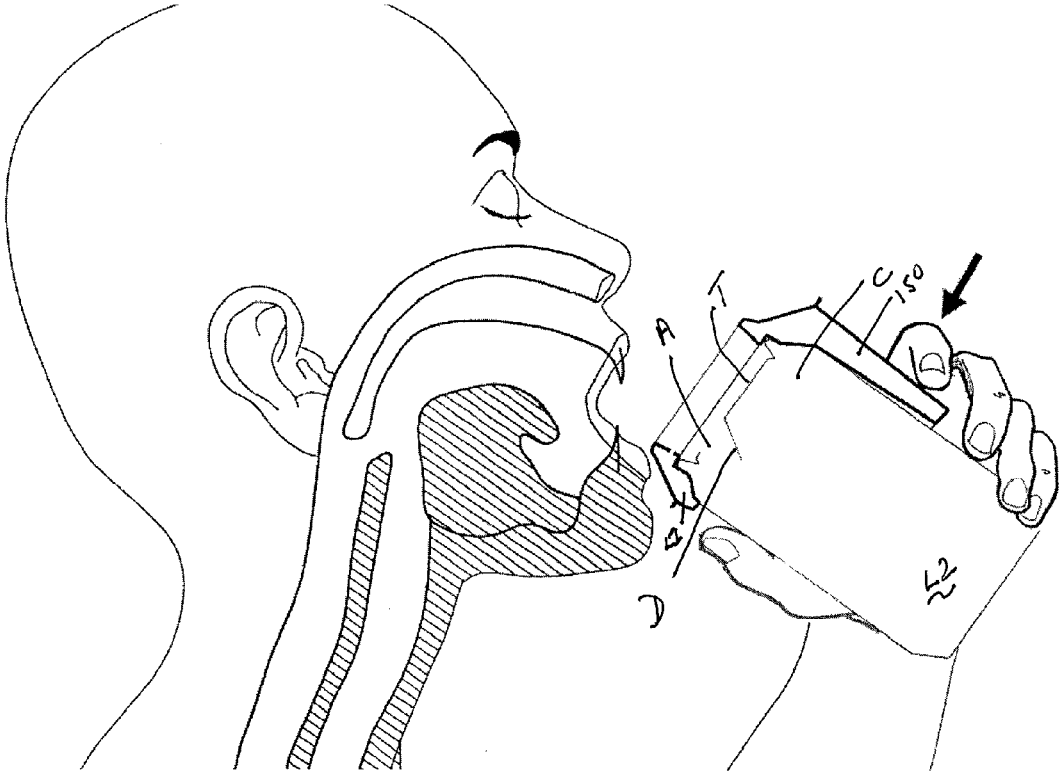
FIG. 11 is a cross-sectional view of the device attached to a standard aluminum can and showing the levels of the two streams of liquid and how they will simultaneously flow when the device and can are simultaneously tipped into the user's mouth (head and mouth of the user being shown in partial cross section and partial side view)
Figure 12A:
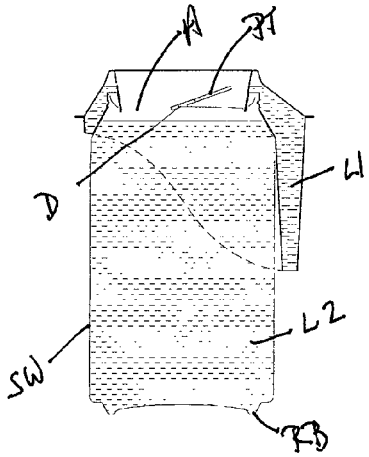
FIGS. 12*a*-12*e* are sequential cross sectional views of the device attached to a standard aluminum can showing the levels of the two streams of liquid as the device and can are simultaneously tipped or tilted for pouring or drinking.
Figure 12B:
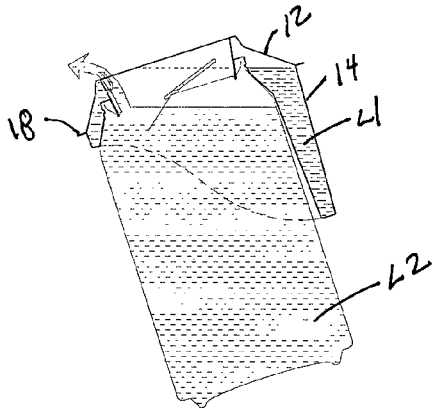
Figure 12C:
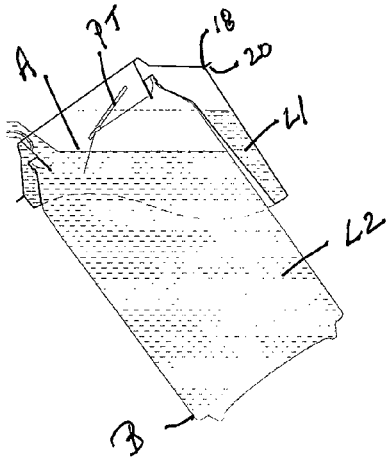
Figure 12D:
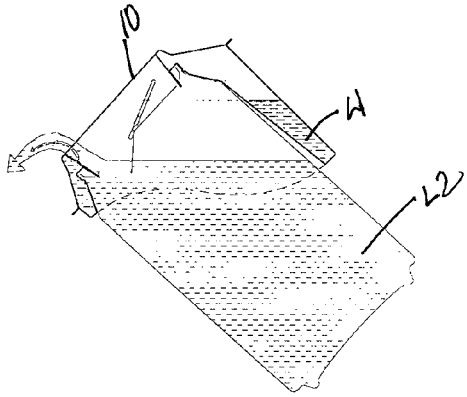
Figure 12E:
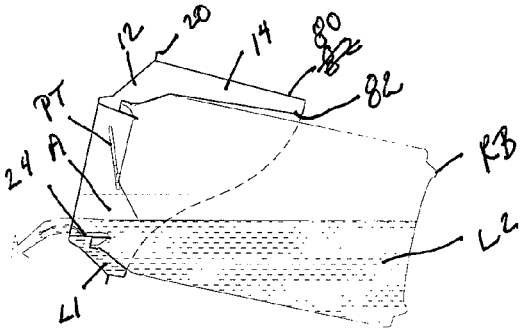

As seen in FIG. 11, the user can, if desired, slightly push down on the outside smooth wall 80 of the device, if an extra amount of liquid L1 is desired, beyond that provided merely by tilting, gravity and the geometry of the device, vis a vis the can C. Since the outside wall is inwardly resilient, a consequence of the resilient nature of the outside smooth wall of the device 10, a radially inward push by the user's finger will increase the internal air pressure of the device which will result in pushing out of more liquid L1 to the hoped-for delight of the user. Alternatively, merely tilting the can C and the device 10 at the same time will result in substantially a uniform concentration and mixture of liquid L1 with liquid L2, on a per sip or per tilt and pour basis.

As seen in FIGS. 12*a* through 12*e*, the device 10 on a can 12 is shown in various tilting positions so as to illustrate the liquid flows L1 and L2. The user's hand is not shown in these Figs. for ease of illustration and understanding. As a consequence of the location of the pouch of liquid L1 (primarily opposed to the pour opening 24) and the pour opening 24 being near the aperture A of the can, a small tilting of the can and device will initiate flow of liquid L1 (and, of course L2 along with it). Flow of liquids out of the can and the device is, of course, a function of whether or not any liquid L1 and/or L2 remains above the pour opening 24 and the aperture A of the device and can, respectively. Continued tilting to cause more and more liquid L2 to flow from the can will be accompanied, as seen in the Figs by more and more flow of liquid L1. So, on a per sip or per tilt/pour basis, the concentration of liquid L1 within and with liquid L2 is maintained. Ideally, the flow of liquid L1 is simultaneously initiated with the flow of liquid L2 from the can, the concentration of L1 and L2 maintained throughout the emptying of the can C and the device 10 and the total consumption of the device 10 and the can C is substantially simultaneous. Other geometries can be designed so that, for example, in a pharmaceutical context, all of the liquid of device 10 is poured and consumer with the first ⅓ of the liquid L2 of the can C (since consumers may not finish all of the contents of the can at the same sitting and it is desired to have the user drink all of the medication). This might be useful, for example, in providing pharmaceutical liquids along with cola to children or flavoring medicine for consumption from small cans of medicine.

After consumption and use, the device can be removed and discarded as appropriate. In an alternate embodiment, the device is refillable through the same pour opening (and then resealed for later reuse) or through a removable and then repluggable fill opening.

It will be understood by those of ordinary skill in the art that various changes may be made and equivalents may be substituted for elements without departing from the scope of the invention. In addition, many modifications may be made to adapt a particular feature or material to the teachings of the invention without departing from the scope thereof. Therefore, it is intended that the invention not be limited to the particular embodiments disclosed, but that the invention will include all embodiments falling within the scope of the claims.

We claim:

1. A first-liquid holding device for use with a conventional soda-like can having a convex curved sidewall and a top with an asymmetrically positioned and openable aperture, said can also having an internal chamber for holding a second liquid, the first-liquid holding device comprising:

attachment means for allowing selective securement of said first-liquid holding device to the top of said can; and a pouch for holding a first liquid, said pouch having a primary area extending down the sidewall of said can, said primary area holding the bulk of said first liquid;

said first liquid holding device also comprising a pour opening in fluid communication with said pouch, said pour opening being small in dimensional relation to said openable aperture of said soda-like can and locatable proximal to the openable aperture of said soda-like can;

wherein tilting and pouring both said first-liquid holding device and said can causes said first liquid-holding device and the can to pour a first liquid from said device and a second liquid from said can in a metered manner such that the first liquid becomes mixed and entrained with the second liquid and the exhaustion of the first liquid is substantially at the same time as the exhaustion of said second liquid.

2. A first-liquid holding device as claimed in claim 1 wherein said attachment means is an inverted U-shaped channel which mechanically cooperates with a flange of the can.

3. A first-liquid holding device as claimed in claim 1 wherein said attachment means comprises an inverted U-shaped channel for interengagement with a flange on the top of the can and a concave curved wall of said first-liquid holding device which wraps at least partially around the convex curved sidewall of the can.

4. A first-liquid holding device as claimed in claim 1 wherein said pour opening is on one side of said device and said pouch is on the other side of said device.

5. A first-liquid holding device as claimed in claim 1, wherein said pouch is resilient.

6. A first-liquid holding device as claimed in claim 3 wherein said inverted U-shaped channel of said attachment means is radially resilient to allow said device to be snapped around, beneath a lip of and onto a top flange of the can.

7. A first-liquid holding device as claimed in claim 1 further comprising a liquid disposed in said pouch, said liquid including at least one of: a vitamin supplement; an energy boosting liquid; a flavoring; or an alcoholic-based additive for a mixed drink.

8. A first-liquid holding device as claimed in claim 1 wherein said pouch has an inside concave curved wall which corresponds in dimension and shape to the convex curved sidewall of the can to which it is attachable.

9. A first-liquid holding device as claimed in claim 1 made of thin-walled plastic.

10. A first-liquid holding device as claimed in claim 1 made of sheet aluminum.

11. A first-liquid holding device as claimed in claim 1 wherein said pouch is finger pressure compressible to controllably facilitate the flow of first liquid through and out of said pour opening.

12. A first-liquid holding device as claimed in claim 1 further comprising an air vent.

13. A first-liquid holding device for use with a conventional beverage can holding a second liquid and also having a cylindrical convexly-shaped sidewall and an asymmetrical pouring mouth passing through its top for pouring the second liquid from said beverage can, the first-liquid holding device comprising:

a) a holding means for selective securement of said first-liquid holding device to the top of and with a portion adjacent to the sidewall of the beverage can;

b) a pouch for holding a first liquid; said pouch extending at least substantially down the sidewall of the beverage can; and c) a selectively openable first liquid pour opening providing a fluid passageway from the interior of said pouch, said pour opening being opposed to said pouch with respect to the pouring mouth of the beverage can, said pour opening being relatively small in dimension in comparison to said pouring mouth yet located adjacent thereto which allows a first liquid contained in the pouch to pour and entrain and be metered with the second liquid poured from the beverage can such that exhaustion of the first liquid by pouring from said holding device is at about the same time as the exhaustion of the second liquid by pouring the same from said beverage can.

14. A first-liquid holding device as claimed in claim 13 wherein said beverage can is provided with a flange at its top and said holding means comprises an inverted U-shaped channel which snaps around and fits over the flange.

15. A first-liquid holding device as claimed in claim 14 wherein said inverted U-shaped channel is radially resilient.

16. A first-liquid holding device as claimed in claim 15 wherein said inverted U-shaped channel is provided with an inwardly directed protrusion which fits within an annular recess of the flange.

17. A first-liquid holding device as claimed in claim 13 wherein said pouch is attachable to the sidewall of the can by the interaction of a concavely curved inside wall of said first liquid holding device and the convexly curved sidewall of the beverage can.

18. A first-liquid holding device as claimed in claim 13 wherein said pouch comprises a smooth and outwardly curved outside wall and a concavely curved inside wall, defining there between a chamber for holding at least the bulk of said first liquid held by said pouch.

19. A first-liquid holding device as claimed in claim 18 wherein said outside wall and said inside wall are connected by an edge and said edge defines a sine-like curve extending from one side of the device near to said pour opening to the bottom of said pouch, and to the opposed and other side of the device.

20. A first liquid holding device as claimed in claim 13 wherein said pour opening is on a top lip of said device.

21. A first-liquid holding device as claimed in claim 13 further comprising a liquid disposed in said pouch, said liquid including at least one of: a vitamin supplement; an energy boosting liquid; a flavoring; or an alcoholic-based additive for a mixed drink.

22. A first-liquid holding device as claimed in claim 13 wherein said device is provided with a large central annular opening which surrounds the pouring mouth when said device is placed on the beverage can to thereby allows finger access to the top of the beverage can for opening the same.

23. A first-liquid holding device as claimed in claim 13 wherein said pouch is made from thin-walled plastic.

24. A first-liquid holding device as claimed in claim 13 wherein said pour opening is sealable and openable by a removable tab.

25. A first-liquid holding device as claimed in claim 13 wherein said pouch is resilient and compressible to selectively force first liquid out of said pour opening when a finger forces it to be depressed.

26. A first-liquid holding device as claimed in claim 13 further comprising an air vent aperture.

27. A first liquid holding and selective pouring of additive fluid device for securement to a second fluid container with a pouring opening comprising:

a) a basically toroidal-shaped yet hollow, liquid holding first cavity having a central opening and dimensioned to sit on the top of the second fluid container;

b) a fluid opening passing through to said first cavity, said fluid opening being smaller in dimension than said central opening, and directed to pass fluid from said cavity near to said central opening;

c) a liquid holding pouch in fluid communication with said first cavity, said fluid opening and said liquid holding pouch being located opposed to one another around said central opening such that tilting of said can and said device causes fluid to pass by gravity from said pouch, through and from said first cavity and through said fluid opening.

28. A first liquid holding and selective pouring of additive fluid device as claimed in claim 27 wherein said fluid opening is dimensionally smaller than the pouring opening of the second fluid container to which it is selectively secured.

29. A first liquid holding and selective pouring of additive fluid device as claimed in claim 27 wherein said liquid holding pouch has an inside surface which is concavely curved to matingly engage the outside surface of the second fluid container.

30. A first liquid holding and selective pouring of additive fluid device as claimed in claim 27 wherein said liquid holding pouch has an outside surface which is convexly curved.

31. A first liquid holding and selective pouring of additive fluid device as claimed in claim 27 wherein said holding pouch extends at least partially downwardly from said holding cavity and is basically a component of a hollow cylinder.

32. A first liquid holding and selective pouring of additive fluid device as claimed in claim 27 wherein said hollow pouch when secured to the second fluid container holds and pours liquid by a gravity feed that causes the flow of liquid through said fluid opening when said second fluid container is tilted for gravity pouring of the liquid contained therein.

33. A first liquid holding and selective pouring of additive fluid device as claimed in claim 27 wherein said fluid opening is proximal to the pouring opening of the second fluid container.

* * * * *